US005556737A

United States Patent [19]

Nakamura

[11] Patent Number: 5,556,737

[45] Date of Patent: Sep. 17, 1996

[54] METHOD FOR FORMING COLOR IMAGE IN SILVER HALIDE COLOR PHOTOGRAPHIC MATERIAL HAVING REFLECTIVE SUPPORT COATED WITH COMPOSITION OF POLYESTER RESIN AND WHITE PIGMENT

[75] Inventor: Koichi Nakamura, Minami-ashigara, Japan

[73] Assignee: Fuji Photo Film Co., Ltd., Kanagawa-ken, Japan

[21] Appl. No.: 159,495

[22] Filed: Nov. 30, 1993

[30] Foreign Application Priority Data

Nov. 30, 1992 [JP] Japan ..... 4-340988

[51] Int. Cl.[6] ..... G03C 5/38; G03C 1/85; G03C 1/76; G03C 11/00

[52] U.S. Cl. ..... 430/400; 430/363; 430/399; 430/428; 430/372; 430/376; 430/963; 430/533; 430/637; 430/530

[58] Field of Search ..... 430/363, 393, 430/398, 400, 533, 538, 637, 963

[56] References Cited

U.S. PATENT DOCUMENTS

| | | | |
|---|---|---|---|
| 3,143,526 | 8/1964 | Caldwell et al. | 430/533 |
| 4,780,402 | 10/1988 | Remmington | 430/533 |
| 4,847,149 | 7/1989 | Kiyohara et al. | 430/533 |
| 4,892,804 | 1/1990 | Vincent et al. | 430/490 |
| 4,892,806 | 1/1990 | Briggs et al. | 430/449 |
| 5,004,676 | 4/1991 | Meckl et al. | 430/398 |
| 5,009,983 | 4/1991 | Abe | 430/393 |
| 5,176,987 | 1/1993 | Nakamura et al. | 430/380 |
| 5,180,658 | 1/1993 | Kiyohara et al. | 430/533 |
| 5,290,668 | 3/1994 | Ohtani | 430/538 |

FOREIGN PATENT DOCUMENTS

| | | | |
|---|---|---|---|
| 0438156 | 7/1991 | European Pat. Off. . | |
| 0507489 | 10/1992 | European Pat. Off. . | |
| 1422940 | 12/1968 | Germany | 430/637 |
| 59-232342 | 12/1984 | Japan . | |
| 1-298352 | 12/1989 | Japan . | |
| 3-221942 | 9/1991 | Japan . | |
| 3-233452 | 10/1991 | Japan . | |

*Primary Examiner*—Charles L. Bowers, Jr.
*Assistant Examiner*—J. Pasterczyk
*Attorney, Agent, or Firm*—Birch, Stewart, Kolasch & Birch, LLP

[57] ABSTRACT

The present invention relates to a method for forming a color image in a silver halide color photographic material comprising a reflective support having coated thereon a composition comprising a polyester resin and a white pigment mixed and dispersed in said polyester resin, at least one yellow color forming silver halide photosensitive emulsion layer, at least one magenta color forming silver halide photosensitive emulsion layer, and at least one cyan color forming silver halide photosensitive emulsion layer on said support, each of said yellow, magenta and cyan color forming silver halide photosensitive emulsion layers having silver halide grains containing 95 mol % or more of silver chloride, wherein said method comprises the steps of exposing imagewise said silver halide color photographic material to light, developing said imagewise exposed silver halide color photographic material in a color developing solution, subjecting said developed silver halide color photographic material to desilvering by bleaching and fixing, or by bleach-fixing, subjecting said silver halide color photographic material to a washing bath or to a stabilizing bath, and drying said developed silver halide color photographic material, wherein the amount of replenishment of desilvering step (iii) is 0.5 to 3 times the amount of the color developing solution carried over from the developing step (ii) into the desilvering step (iii).

26 Claims, No Drawings

METHOD FOR FORMING COLOR IMAGE IN SILVER HALIDE COLOR PHOTOGRAPHIC MATERIAL HAVING REFLECTIVE SUPPORT COATED WITH COMPOSITION OF POLYESTER RESIN AND WHITE PIGMENT

FIELD OF THE INVENTION

The present invention relates to a method for forming a color image using a silver halide photographic material, and more particularly to a method for forming a color image wherein image stain that occurs after storage of the image obtained by low-replenishing-rate rapid processing is reduced.

The present invention also relates to a method for forming a color image suited to low-replenishing-rate processing wherein the amount of waste liquor is small.

The present invention also relates to a method for forming a color image that can provide a color image excellent in sharpness even in low-replenishing-rate rapid processing.

BACKGROUND OF THE INVENTION

The processing of a silver halide photographic material, for example the processing of a silver halide color photographic material,i comprises a color-developing process and a desilvering process. In the desilvering process, the developed silver produced in the process of color-developing is oxidized (bleached) to a silver salt by a bleaching agent having an oxidation action, and it is removed (fixed) from the photosensitive layers after it is changed together with unused silver halide into a soluble silver by a fixing agent. As the bleaching agent, a ferric(III) ion complex salt (e.g., an aminopolycarboxylic acid/iron(III) complex salt) is mainly used, and as the fixing agent, a thiosulfate is generally used.

Bleaching and fixing are carried out separately in a step of bleaching and in a step of fixing in some cases or are carried out in a single step of bleach-fixing in other cases. Details of these processing steps are described by James in *The Theory of Photographic Process*, 4th edition (1977).

The above-mentioned processing steps are generally carried out by an automatic processor. Particularly, in recent years, rapid processing service for customers is spreading through the installation of small-sized automatic processors called mini-labs in shops. A bleaching agent and a fixing agent are used in one and the same bath, which acts as a bleach-fix bath in the processing of color paper, for the purpose of making the size of processors small and making the processing rapid.

Further, for the purpose of saving resources and preserving the environment, low-replenishing-rate measures are being taken. However, if the low-replenishing-rate measures for a developing solution are taken simply, the accumulation of substances dissolved from the photographic material, particularly iodide ions and bromide ions, which are strong development inhibitors, lowers the development activity, leading to the problem that the rapidness is spoiled. For the purpose of reducing the accumulation of iodide ions and bromide ions and for attaining a rapid process, methods wherein a silver halide photographic material high in silver chloride content is used, which methods are disclosed in JP-A ("JP-A" means unexamined published Japanese patent application) No. 232342/1984, U.S. Pat. No. 5,004,676 and WO 87-04534 (U.S. Pat. No. 4,892,804) are considered to be effective means that makes possible rapid processing under low-replenishing-rate of a developer. Other methods for rapid processing, in which the pH of a developing solution or the processing temperature is elevated are also known.

U.S. Pat. No. 5,176,987 discloses a method that is excellent in preservability of the color image and makes possible low-replenishing-rate and ultra-rapid processing by processing a silver halide photographic material high in the silver chloride content with a color developing solution containing as a color developing agent a hydroxyalkyl-substituted p-phenylenediamine derivative with a specified structure.

To increase the sharpness of color images, JP-A No. 221942/1991 describes a method for rapid processing that uses a color photographic material comprising a paper support that has a water-resistant resin layer formed on the surface thereof and containing an increased amount of a white pigment.

With respect to a step of washing or stabilizing, EP 438156A and JP-A No. 233452/1991 describe that low replenishment rate is made possible by a multi-stage counter flow system and/or a method wherein the water that has been processed with a reverse osmotic film is used again.

Low replenishment of each processing step has thus been attempted and has become an important subject in recent years. However, on the other hand, when the amount of replenishment of a desilvering bath is lowered, since the accumulated amount of the color-developing agent carried over from the developing bath into the desilvering bath increases, the amount of the developing agent remaining in the processed photographic material increases in the case of short-period processing. Due to this, during storage of the image, disadvantageously, stain is liable to be formed. Further, it is also known that when the amount of washing water is decreased, the concentrations of iron salts and other salts in the washing bath increase and they remain in the photographic material, resulting in the defect that the dye image is deteriorated after long-term storage.

That is, it has become apparent that when low-replenishing-rate processing and/or ultra-rapid processing is carried out, stain produced during storage due to the color-developing agent remaining in the processed photographic material (aging stain) is liable to occur conspicuously. It has become apparent that this stain is apt to be formed particularly when the replenishing amount of the desilvering bath, and/or the washing bath or the stabilizing bath, is lowered and the processing is short-period and is carried out continuously. It has also been found that stain is liable to be formed conspicuously when the washing or the stabilizing is insufficient to allow the iron ion concentration and the salt concentration in the photographic material to decrease.

Thus, it is desired to attain a method for forming an image that can provide an image that, while retaining the high conventional image quality, produces less stain even by low-replenishing-rate rapid processing.

The occurrence of stain that will be caused during storage and that is referred to in the present invention will now be described further. In processing of a color photographic material, for example, if the step of bleach-fixing is run with the rate of the replenishment decreased in order to make the processing rapid and simple, dye stuffs, sensitizing dyes, and silver halides in the photographic material dissolve out into the bleach-fix bath, and also the color-development agent from the developing bath accumulates in the bleach-fix bath in a large amount. In this running process, the rate of the replacement of the solution lowers due to the low replenishment rate, and as the color-developing agent accumulates, it becomes impossible to remove completely the color developing agent from the photographic material if the bleach-fix time is short. In particular, the further the rate of replenishment of the subsequent washing step or stabilizing step is lowered, the harder it becomes to remove the above undesired components.

If the color-developing agent remains, in particular out of the above undesired components, pink stain occurs during storage of the image, which is a significant problem. If the image is stored without exposure to air, this stain occurs less but is liable to occur with the lapse of time under high humidity.

SUMMARY OF THE INVENTION

According to the present invention, there is provided a method for forming a color image comprising the low-replenishing-rate rapid processing, particularly in the low-replenishing-rate rapid processing in a desilvering step, by which method the occurrence of stain during storage of an image can be minimized, resulting, even if the amount of waste liquor from the processor apparatus is reduced considerably, in a high-quality color image, particularly in a high-quality color print image.

Therefore, an object of the present invention is to provide a method for forming a color image which is obtained by low-replenishing-rate rapid processing that can decrease the formation of stain of the image during storage.

Another object of the present invention is to provide a method for forming a color image, which is high in image quality and is obtained by low-replenishing-rate processing wherein the amount of waste liquor is small.

The above and other objects, features, and advantages of the invention will become fully apparent in the following description.

DETAILED DESCRIPTION OF THE INVENTION

Taking the above into consideration, the present inventors have keenly studied means of reducing stain (the amount of coloring components) due to the color-developing agent remaining in the photographic material and unexpectedly have found that, when use is made of a paper support at least whose surface to be emulsion-coated is covered with a composition formed by mixing a resin of a polyester with a white pigment, stain occurs less. It is contrary to expectation that the occurrence of stain, particularly the occurrence of stain after storage under high humidity, can be suppressed by putting the composition utilized in the present invention between a photosensitive layer and a paper support, in particular using the polyester utilized in the present invention instead of the conventionally used polyethylene. In particular, it has been found that the occurrence of stain can be suppressed when the photographic materials that are processed rapidly with the low-replenishing-rate are piled and stored.

The oxygen permeability constant of the polyester utilized in the present invention is about 1/100th of that of polyethylenes, and compositions having a low oxygen permeability constant have been preferable because with them stain is less liable to occur. With respect to the oxygen permeability constant of polymers, details are described by J. Brandrup and E. H. Immergut in *Polymer Handbook,* 2nd edition (1975). By developing this finding, the present invention has been attained as follows.

(1) A method for forming a color image utilizing a silver halide color photographic material having photosensitive hydrophilic colloid layers containing at least three silver halide emulsion grains that are different in color sensitivity, and each layer contains any one of a coupler capable of color-forming of yellow, magenta, or cyan, respectively, and non-photosensitive hydrophilic colloid layers, on a reflective support, according to exposing to light imagewise, color-developing, desilvering, washing or stabilizing, and drying; wherein the silver halide in the emulsion layer contains 95 mol % or more of silver chloride, and the reflective support is, on its at least one surface to be emulsion-coated is covered with a composition of polyester resin containing a white pigment mixed and dispersed into therein, and wherein the amount of the replenishment of the desilvering step is 0.5 to 3 times the amount of the developing solution carried over from the color-developing bath into the desilvering bath.

(2) The method for forming a color image stated under (1), wherein the washing bath or the stabilizing bath is operated in a multi-stage counterflow mode and the iron ion concentration of the final bath of the multi-stage is 30 ppm or less.

(3) The method for forming a color image stated under (1), wherein said polyester resin is obtained by condensing 50 wt % or more of a dicarboxylic acid with a diol.

(4) The method for forming a color image stated under (1), wherein the polyester of the polyester resin is selected from a polyester resin whose major component is a polyethylene terephthalate.

(5) The method for forming a color image stated under (1), wherein the polyester of the polyester resin is synthesized by condensation polymerization of dicarboxylic acid, that is a mixture of terephthalic acid and isophthalic acid in a molar ratio of from 9:1 to 2:8, and a diol, the surface to be emulsion-coated of the support is coated with a composition containing the polyester resin mixed and dispersed with a white pigment, and the other surface is coated with a resin or a composition containing the resin mixed and dispersed with a powder.

(6) The method for forming a color image stated under (1), wherein the polyester of the polyester resin is synthesized by condensation polymerization of dicarboxylic acid, that is a mixture of terephthalic acid and naphthalenedicarboxylic acid in a molar ratio of from 9:1 to 2:8, and a diol, the surface to be emulsion-coated of the support is coated with a composition containing the polyester resin mixed and dispersed with a white pigment, and the other surface is coated with a resin or a composition containing the resin mixed and dispersed with a powder.

(7) The method for forming a color image stated under (3), wherein the diol is ethylene glycol.

(8) The method for forming a color image stated under (1), wherein the white pigment is titanium oxide, and the weight ratio of the titanium oxide to the resin is from 5:95 to 40:60.

(9) The method for forming a color image stated under (1), wherein the period of time of the desilvering step is 5 to 25 sec.

(10) The method for forming a color image stated under (1), wherein the period from the start of the developing process to the end of the drying process is within 120 sec.

(11) The method for forming a color image stated under (1), wherein said color photographic material is exposed to light in a scanning exposure method with the exposure time being $10^{-4}$ sec or less per picture element.

(12) The method for forming a color image stated under (1), wherein the color-developing agent for use in the color developer is a p-phenylenediamine derivative represented by the following formula (Dev):

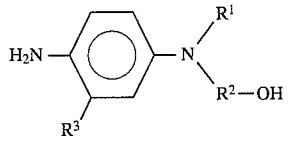

formula (Dev)

wherein $R^1$ and $R^3$ each represent an alkyl group having 1 to 4 carbon atoms, and $R^2$ represents a straight-chain or branched chain alkylene group having 3 to 4 carbon atoms.

When the color photographic material utilized in the present invention was rapidly processed, with the rate of the replenishment lowered, and the amount of the replenishment of the washing bath or the stabilizing bath in addition to the bleach-fix bath, was reduced, then the amount of the bleach-fix solution mixed into the washing bath or the stabilizing bath increased, and when the amount of the mixing exceeded a certain extent, then stain increased. Based on this finding, by controlling the iron ion concentration in the washing bath or the stabilizing bath to within a certain amount, stain can be made less. That is, by carrying out the washing process in such a way that the iron concentration of the washing final bath is 30 ppm or less, preferably 10 ppm or less, stain can be made less. Although details are described later, for example, by using preferably a three-stage or higher multi-stage counter-flow tank and/or a reverse osmotic film to purify the washing water, a washing process with the rate of the replenishment lowered could be attained. As will be understood from this, it has also been found that preferably the processing time of the final bath of the multi-stage washing tank is made longer than the processing time of the other tanks.

In the present invention, the extent of occurrence of stain in the low-replenishing-rate rapid processing changes depending on the kind of developing agent in the color-developing solution and it has been found that the stain is less liable to occur when use is made of a hydroxyalkyl-substituted p-phenylenediamine derivative with a specific structure having a rapid-development-processing ability described in JP-A No. 443/1992.

That is, by using the photographic material having the above constitution in combination with the processing method described above in the present invention, a method for forming a color image has been attained wherein the preservability of the image obtained by the low-replenishing-rate rapid processing described above in the present invention, particularly by the low-replenishing-rate rapid processing in the bleach-fix step and/or washing or stabilizing step, is excellent.

The oxygen permeability constant of the polyester utilized in the present invention is about 1/100th of that of polyethylenes, and compositions having a low oxygen permeability constant are apt to cause stain less and therefore are preferable. With respect to the oxygen permeability constant of polymers, details are described by J. Brandrup and E. H. Immergut in *Polymer Handbook,* 2nd edition (1975). By developing this finding, the present invention has been attained as described above.

The present invention will now be described in detail below.

The reflective support, for example a paper support, in the present invention is necessary to be a reflective support prepared by covering at least the surface to be emulsion-coated of the support, for example a paper support, with a composition containing a white pigment mixed and dispersed into a resin containing 50 wt % or more of a polyester.

Preferably, the opposite surface of the reflective support is coated with such a composition.

This polyester is one synthesized by condensation polymerization of at least one kind of dicarboxylic acid and at least one kind of diol. As preferable dicarboxylic acids, for example, terephthalic acid, isophthalic acid, and naphthalenedicarboxylic acid can be mentioned. As preferable diols, for example, ethylene glycol, butylene glycol, neopentyl glycol, triethylene glycol, butanediol, hexylene glycol, an adduct of bisphenol A ie. (2,2-bis(4'-hydroxphenyl)-propane with ethylene oxide (2,2-bis(4-(2-hydroxyethyloxy)phenyl-)propane), and 1,4-dihydroxymethylcyclohexane can be mentioned.

In the present invention, various polyesters prepared by condensation (co)polymerization of one or a mixture of these dicarboxylic acids with one or a mixture of these diols can be used. In particular, at least one of the dicarboxylic acids is preferably terephthalic acid. As the dicarboxylic acid component, a mixture of terephthalic acid and isophthalic acid (in a molar ratio of from 9:1 to 2:8), or a mixture of terephthalic acid and naphthalenedicarboxylic acid (in a molar ratio of from 9:1 to 2:8), is also preferably used. As the diol, ethylene glycol or a mixed diol containing ethylene glycol is preferably used. Preferably the molecular weight of these polymers is 30,000 to 50,000.

Also, a mixture of two or more of these polyesters having different compositions is preferably used. Further, a mixture of these polyesters with other resins can also be used preferably. As the other resins that can be mixed, wide varieties of resins capable of being extruded 270° to 350° C. can be chosen. Examples of such resins include polyolefins, for example polyethylenes and polypropylenes; polyethers, for example polyethylene glycols, polyoxymethylenes, and polyoxypropylenes; as well as polyester polyurethanes, polyether polyurethanes, polycarbonates, and polystyrenes. One or more of these resins that can be blended can be used. For instance, 90 wt % of a polyethylene terephthalate can be mixed with 6 wt % of a polyethylene and 4 wt % of a polypropylene. Although the mixing ratio of the polyester to the other resin varies depending on the type of the resin to be mixed, in the case of polyolefins, suitably the weight ratio of the polyester to the other resin is 100:0 to 80:20. If the ratio falls outside this range, the physical properties of the mixed resin drop drastically. In the case of resins other than polyolefins, the polyester is mixed with the resin in a weight ratio ranging from 100:0 to 50:50. If the ratio of polyester is too small, the effect of the present invention cannot be obtained satisfactorily.

As the white pigment to be mixed and dispersed into the polyester of the reflective support utilized in the present invention, inorganic pigments, such as titanium oxide, barium sulfate, lithopone, aluminum oxide, calcium carbonate, silicon oxide, antimony trioxide, titanium phosphate, zinc oxide, white lead, and zirconium oxide; and finely divided powders of an organic compound, such as finely divided powders of a polystyrene and a styrene/divinylbenzene copolymer, can be mentioned.

Among these pigments, titanium dioxide is particularly effectively used. The titanium dioxide may be of the rutile type or the anatase type, and it may be one prepared by either the sulfate process or the chloride process. Specific trade names of titanium dioxide include, for example, KA-10 and KA-20, manufactured by Titanium Kogyo, and A-220, manufactured by Ishihara Sangyo.

Preferably, the white pigment to be used has an average particle diameter of 0.1 to 0.8 μm. If the average particle diameter is too small, it is not preferable because it is difficult to disperse the white pigment uniformly into the resin. On the other hand, if the average particle diameter is too large, the whiteness becomes unsatisfactory and the coated surface becomes rough, thereby adversely affecting the image quality.

The ratio of the polyester to the white pigment is from 98:2 to 30:70, preferably from 95:5 to 50:50, and particularly preferably from 90:10 to 60:40. If the ratio of the white pigment is too small, it cannot contribute satisfactorily to the whiteness; while if the ratio is too large, the smoothness of the surface of the obtained support for photographic paper is unsatisfactory and a support for photographic paper excellent in glossiness cannot be obtained.

The polyester and the white pigment are mixed together with a dispersing agent, such as a metal salt of a higher fatty acid, a higher fatty acid ethyl ester, a higher fatty acid amide, and a higher fatty acid, by a kneader, such as a twin roll, a triplet roll, a kneader, and a Banbury mixer. An antioxidant may be contained in the resin layer, an amount of 50 to 1,000 ppm based on the resin.

The thickness of the polyester/white pigment composition that covers the surface to be emulsion-coated of the base paper of the present reflective support is preferably 5 to 100 μm, more preferably 5 to 80 μm, and particularly preferably 10 to 50 μm. If the cover is too thick, problems related to the physical properties arise and, for example, the resin becomes too brittle and cracks. On the other hand, if the cover is too thin, the waterproofness of the coating that is originally intended is apt to be damaged; in addition, the whiteness and the surface smoothness cannot be satisfied simultaneously; and with respect to the physical properties the coating becomes too soft, which are not preferable.

Preferably the thickness of the resin or the resin composition that covers the surface opposite to the emulsion-coated surface of the base paper is 5 to 100 μm, more preferably 10 to 50 μm; and if the thickness is too large, problems related to the physical properties arise and, for example, the resin becomes too brittle and cracks. If the thickness is too small, the waterproofness of the covering that is originally intended is impaired; and in addition with respect to the physical properties the covering becomes too soft, which is not preferable. The resin or resin composition that covers this surface preferably comprises a polyester, such as polyethyleneterephthalate, or a polyolefin, such as polyethylene and polypropylene.

As a process for covering the emulsion-coated surface and the opposite surface, for example, the melt extrusion lamination process can be mentioned.

The base paper to be used for the reflective support utilized in the present invention is chosen from materials generally used for photographic paper. That is, the main raw material is natural pulp from, for example, softwoods and hardwoods, to which, if necessary, is added, for example, a filler, such as clay, talc, calcium carbonate, and urea resin fine particles; a sizing agent, such as a rosin, an alkylketene dimer, a higher fatty acid, an epoxidized fatty acid amide, paraffin wax, and an alkenyl succinate; a paper strength-reinforcing agent, such as a starch, a polyamide polyamine epichlorohydrin, and a polyacrylamide; and a fixing agent, such as aluminum sulfate, and a cationic polymer.

Although the kind and thickness of the base paper support are not particularly restricted, desirably the basis weight is 50 g/m$^2$ to 250 g/m$^2$. Preferably, the base paper is surface-treated by applying heat and pressure thereto, for example, by a machine calender or a supercalender, in order to improve the smoothness and the planeness.

Before the base paper is coated with the mixed composition of a polyester and a white pigment, preferably the surface of the base paper is pretreated, for example, with a corona discharge treatment, a flame treatment, or an undercoat.

When a polyester, such as a polyethylene terephthalate, is used, since the adhesion to the photographic emulsion is weak in comparison with the case wherein a polyethylene is used, preferably, after the melt extrusion lamination of the polyester to the base paper, the polyester surface is subjected to a corona discharge treatment and a hydrophilic colloid layer is applied.

Also preferably the surface of the thermoplastic resin, mainly made up of a polyester, is coated with an undercoat liquid containing a compound represented by the following formula (U):

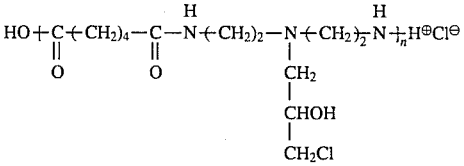

formula (U)

n is an integer of 1 to 7

Preferably the coating amount of the compound represented by formula (U) is 0.1 mg/m$^2$ or more, more preferably 1 mg/m$^2$ or more, and most preferably 3 g or m/m$^2$ or more; and the larger the amount is, the higher the adhesion can be increased, but an excessive amount is disadvantageous in view of cost.

In order to improve the coating ability of the undercoat liquid to the resin surface, preferably alcohols, such as methanol, are added. In this case, the proportion of the alcohols is preferably 20 wt % or more, more preferably 40 wt % or more, and most preferably 60 wt % or more. To improve the coating ability further, various surface-active agents, such as anionic surface-active agents, cationic surface-active agents, ampholytic surface-active agents, nonionic surface-active agents, fluorine-containing surface-active agents, and organosilicon surface-active agents, are preferably added.

Further, preferably, a water-soluble polymer, such as gelatin, is added to obtain a good surface coated with the undercoat.

In view of the stability of the compound of formula (U), preferably the pH of the solution is 4 to 11, more preferably 5 to 10.

Before applying the undercoat solution, preferably the thermoplastic resin surface is treated. As the surface treatment, for example, a corona discharge treatment, a flame treatment, or a plasma treatment can be used.

To apply the undercoat solution, a generally well-known coating process can be used, such as a gravure coating process, a bar coating process, a dip coating process, an air-knife coating process, a curtain coating process, a roller coating process, a doctor coating process, and an extrusion coating process.

The drying temperature of the coat is preferably 30° to 100° C., more preferably 50° to 100° C., and most preferably 70° to 100° C.; the upper limit is determined by the heat resistance of the resin, and the lower limit is determined by the production efficiency.

The color photographic material in the present invention can be formed by applying at least one yellow-color-forming silver halide emulsion layer, at least one magenta-color-forming silver halide emulsion layer, and at least one cyan-color-forming silver halide emulsion layer on a support having a reflective layer. In a common color photographic printing paper, by adding at least one color coupler capable of forming dyes having relationships complementary to lights to which the silver halide emulsions are sensitive, the color can be reproduced by the subtractive color process. A common color photographic printing paper can be formed in such a manner that silver halide emulsion grains are spectrally sensitized with a blue-sensitive spectral sensitizing dye, a green-sensitive spectral sensitizing dye, and a red-sensitive spectral sensitizing dye, in the order of the above color-forming layers, and they are applied on a support in the above-stated order. However, the order may be different. In view of the rapid processing, there is a case wherein a photosensitive layer containing silver halide grains having the greatest average grain size is preferably the uppermost layer; or in view of the preservability under exposure to light, there is a case wherein the lowermost layer is preferably a magenta color-forming photosensitive layer.

The photosensitive layers and the hues that will be formed by color forming may be formed not to have the above correspondence, and at least one infrared photosensitive silver halide emulsion layer can be used.

As the silver halide grains for use in the present invention, it is necessary that silver chloride grains, silver chlorobromide grains, or silver bromochloroiodide grains containing 95 mol % or more of silver chloride are used. Particularly, in the present invention, in order to shorten the development processing time, silver chlorobromide grains or silver chloride grains substantially free from silver iodide can preferably be used. Herein the expression "substantially free from silver iodide" means that the silver iodide content is 1 mol % or less, preferably 0.2 mol % or less. On the other hand, for the purpose of increasing high-intensity sensitivity, spectral sensitization sensitivity, or long-term stability of the photographic material, there is a case wherein high-silver-chloride grains containing 0.01 to 3 mol % of silver iodide on the emulsion surface is preferably used as described in JP-A No. 84545/1991. Although the halogen composition of the emulsion may be different or uniform from grain to grain, when an emulsion having a halogen composition uniform from grain to grain is used, the properties of the grains can be easily made homogeneous. With respect to the halogen composition distribution in the silver halide emulsion grains, for example, grains having the so-called uniform-type structure, wherein the halogen composition is uniform throughout the grains; grains having the so-called layered-type structure, wherein the halogen composition of the core in the silver halide grains is different from that of the shell (consisting of a layer or layers) surrounding the core; or grains having a structure wherein non-layered parts different in halogen composition are present in the grains or on the surface of the grains (if the non-layered parts different in halogen composition are present on the surface of the grains, they may be joined to the edges, corners, or planes of grains) may suitably be chosen. To secure a high sensitivity, it is more advantageous to use one of the latter two than to use grains having a uniform-type structure and the latter two are also preferable in view of pressure-resistance properties. If the silver halide grains have the above structure, the boundary of parts different in halogen composition may be a clear boundary, an obscure boundary formed by a mixed crystal due to the difference of the composition, or a boundary wherein the structure is continuously changed positively.

In a high-silver-chloride emulsion to be used in the present invention, preferably the silver bromide localized phase is layered or non-layered in the silver halide grains and/or on the surface of the grains as described above. The halogen composition of the above localized phase preferably has a silver bromide content of at least 10 mol %, more preferably the content is more than 20 mol %. The silver bromide content of the silver bromide localized layer can be analyzed, for example, by using the X-ray diffraction method (described, for example, in *Shin-jikkenkagaku-koza* 6, *Kozokaiseki*, edited by Nihonkagakukai, published by Maruzen). The localized phase may be present in the grains or on the edges, corners, or planes of the grains and one preferable example is one wherein the localized phase is grown epitaxially on the corners of the grains.

For the purpose of decreasing the replenishment rate of the development processing solution, it is effective to increase further the silver chloride content of the silver halide emulsion. In that case, an emulsion comprising nearly pure silver chloride, for example an emulsion having a silver chloride content of 98 to 100 mol %, is also preferably used.

The average grain size of the silver halide grains contained in the silver halide emulsion for use in the present invention (the average grain size is calculated in such a way that, by assuming the diameters of circles equivalent to the projected areas of the grains to be the grain sizes, its number average is designated as the average grain size) is preferably 0.1 to 2 μm.

The grain size distribution of them is preferably a monodisperse distribution wherein the deviation coefficient (which is obtained by dividing the standard deviation of the grain size distribution by the average grain size) is preferably 20% or less, desirably 15% or less, and more preferably 10% or less. At that time, for the purpose of obtaining a wide latitude, it is also preferably carried out that such monodisperse emulsions are blended to be used in one layer or are applied in layers.

With respect to the form of the silver halide grains contained in the photographic emulsion, a regular crystal form, such as a cubic form, a tetradecahedral form, or an octahedral form, an irregular crystal form, such as a sphere form or a tabular form, or a composite of these can be used. Also a mixture of various crystal forms can be used. In the present invention, it is desired that, out of these, the above regular crystal form amounts to 50% or more, preferably 70% or more, and more preferably 90% or more, in the grains.

Besides these, an emulsion wherein tabular grains having an average aspect ratio (the diameter/thickness in terms of circles) of 5 or more, preferably 8 or more, amount to over 50% in all the grains in terms of projected areas can be preferably used.

The silver chlorobromide emulsion or the silver chloride emulsion for use in the present invention can be prepared by processes described, for example, by P. Glafkides in *Chimie et Phisique Photographique* (published by Paul Montel, 1967), by G. F. Duffin in *Photographic Emulsion Chemistry* (published by Focal Press, 1966), and by V. L. Zelikman et al. in *Making and Coating Photographic Emulsion* (published by Focal Press, 1964).

The localized phase of the silver halide grains utilized in the present invention or its substrate preferably contains different metal ions or their complex ions. Preferable metal ions are selected from ions of metals belonging to Groups VIII and IIb of the Periodic Table, their complex ions, lead ions, and thallium ions. Mainly, in the localized phase, ions selected from iridium ions, rhodium ions, and iron ions, and their complex ions, can be used; and mainly, in the substrate, ions of metals selected from osmium, iridium, rhodium, platinum, ruthenium, palladium, cobalt, nickel, iron, etc., and their complex ions can be used in combination. The localized phase and the substrate may be different in their kind of the metal ions and the concentration of the metal ions. Several of these metals can be used. Particularly, it is preferable to allow an iron compound and an iridium compound to be present in the silver bromide localized phase.

These metal-ion-providing compounds are incorporated in the localized phase of the silver halide grains utilized in the present invention and/or some other grain part (substrate) at the time of the formation of silver halide grains by means, for example, of adding them into an aqueous gelatin solution, an aqueous halide solution, an aqueous silver salt solution, or other aqueous solution serving as a dispersing medium, or by adding silver halide fine grains already containing the metal ions and dissolving the fine grains.

The metal ions to be used in the present invention may be incorporated in emulsion grains before, during, or immediately after the formation of the grains, which time will be selected depending on their position in the grains.

Generally the silver halide emulsion for use in the present invention is chemically and spectrally sensitized.

As the chemical sensitization, that uses a chalcogen sensitizer (specifically, sulfur sensitization, which typically includes the addition of an unstable sulfur compound; selenium sensitization, which uses a selenium compound; or tellurium sensitization, which uses a tellurium compound:), noble metal sensitization, typically such as gold sensitization, and reduction sensitization can be used alone or in combination. With respect to compounds used in chemical sensitization, those described in JP-A No. 215272/1987, page 18 (the right lower column) to page 22 (the right upper column), are preferably used.

The effects of constitution of photographic material utilized in the present invention is more remarkable when a high-silver-chloride emulsion subjected to a gold-sensitization is used.

The emulsion used in the present invention is a so-called surface latent image-type emulsion, wherein a latent image is mainly formed on the grain surface.

To the silver halide emulsion for use in the present invention, various compounds or their precursors can be added for the purpose of preventing fogging during the production process, storage, or the processing of the photographic material, or for the purpose of stabilizing the photographic performance. Specific examples of these compounds are described in the above-mentioned JP-A No. 215272/1987, pages 39 to 72, which compounds are preferably used. Further, 5-arylamino-1,2,3,4-thiatriazole compounds (whose aryl residues have at least one electron-attracting group respectively) described in EP 0447647 can also be preferably used.

The spectral sensitization is carried out for the purpose of spectrally sensitizing each emulsion layer of the present photosensitive material to a desired wavelength region of light.

In the photographic material utilized in the present invention, as spectral sensitizing dyes used for spectral sensitization for blue, green, and red regions, for example, those described by F. M. Harmer in *Heterocyclic compounds-Cyanine dyes and related compounds* (published by John Wiley & Sons [New York, London], 1964) can be mentioned. As specific examples of the compounds and the spectral sensitization, those described in the above-mentioned JP-A No. 215272/1987, page 22 (the right upper column) to page 38, are preferably used. As the red-sensitive spectral sensitizing dyes for high-silver-chloride emulsion grains high in silver chloride content, spectral sensitizing dyes described in JP-A No. 123340/1991 are very preferable in view, for example, of the stability, the strength of the adsorption, and the temperature dependence of the exposure.

In the case wherein the photographic material utilized in the present invention is to be spectral sensitized effectively in the infrared region, sensitizing dyes described in JP-A No. 15049/1991, page 12 (the left upper column) to page 21 (the left lower column); in JP-A No. 20730/1991, page 4 (the left lower column) to page 15 (the left lower column); in EP-0,420,011, page 4, line 21, to page 6, line 54; in EP-0,420,012, page 4, line 12, to page 10, line 33; in EP-0,443,466; and in U.S. Pat. No. 4,975,362 are preferably used.

To incorporate these spectral sensitizing dyes into the silver halide emulsion, they may be directly dispersed into the emulsion, or after they are dissolved in a solvent or a combination of solvents, such as water, methanol, ethanol, propanol, methyl Cellosolve, and 2,2,3,3-tetrafluoropropanol, the solution may be added to the emulsion. Also the spectral sensitizing dye may be formed together with an acid or a base into an aqueous solution, as described in JP-B ("JP-B" means examined Japanese patent publication) Nos. 23389/1969, 27555/1969, and 22089/1982, or the spectral sensitizing dye may be formed together with a surface-active agent into an aqueous solution or a colloid dispersion, as described in U.S. Patent. Nos. 3,822,135 and 4,006,025, and the obtained aqueous solution or colloid dispersion may be added to the emulsion. Also after the spectral sensitizing dye may be dissolved in a solvent Substantially immiscible with water, such as phenoxyethanol, the solution is dispersed in water or a hydrophilic colloid and is added to the emulsion. The spectral sensitizing dye may be directly dispersed in a hydrophilic colloid, as described in JP-A Nos. 102733/1978 and 105141/1983, and the dispersion is added to the emulsion. The time at which the dispersion or solution is added to the emulsion may be at any stage of the preparation of the emulsion, which time is hitherto known and considered useful. That is, the dispersion or the solution may be added before or during the formation of grains of the silver halide emulsion, or during the period from immediately after the formation of grains till the washing step, or before or during the chemical sensitization, or during the period from immediately after the chemical sensitization till the cooling and solidifying of the emulsion, or at the time the coating solution is prepared. Although generally the addition of the dispersion or the solution is carried out in a period after the completion of the chemical sensitization and before the application, the dispersion or the solution may be added together with a chemical sensitizer to carry out spectral sensitization and chemical sensitization at the same time, as described in U.S. Pat. Nos. 3,628,969 and 4,225,666; or the addition may be carried out before chemical sensitization, as described in JP-A No. 113928/1983; or the dispersion or the solution may be added before the completion of the precipitation of the silver halide grains, to allow the spectral sensitization to start. Further, as taught in U.S. Pat. No. 4,225,666, it is possible that the spectrally sensitizing dye may be divided into two portions and added: one portion is added prior to chemical sensitization, and the other is added after the chemical sensitization. As shown in U.S. Pat. No. 4,183,756, the dispersion or the solution may be added at any time during the formation of silver halide grains. In particular, the sensitizing dye is preferably added before the washing step of the emulsion or before chemical sensitization of the emulsion.

The amount of these spectral sensitizing dyes to be added varies widely depending on the case and is preferably in the range of $0.5\times10^{-6}$ to $1.0\times10^{-2}$ mol, more preferably $1.0\times10^{-6}$ to $5.0\times10^{-3}$ mol, per mol of the silver halide.

In the present invention, if a sensitizing dye has spectral sensitization sensitivity particularly in the range from the red region to the infrared region, it is preferable to use additionally a compound described in JP-A No. 157249/1990, page 13 (the right lower column) to page 22 (the right lower column). By using these compounds, the preservability of the photographic material, the stability of the processing, and the supersensitizing effect can be increased specifically. In particular, additional use of compounds of general formulae (IV), (V), and (VI) in that patent is particularly preferable. These compounds are used in an amount of $0.5\times10^{-5}$ mol to $5.0\times10^{-2}$ mol, preferably $5.0\times10^{-5}$ mol to $5.0\times10^{-3}$ mol, per mol of the silver halide and the advantageous amount is in the range of 0.1 to 10,000, preferably 0.5 to 5,000, times one mol of the sensitizing dye.

The photosensitive material utilized in the present invention is used in a print system using common negative printers, and also it is preferably used for digital scanning exposure that uses monochromatic high-density light, such as a second harmonic generating light source (SHG) that comprises a combination of a nonlinear optical crystal with a semiconductor laser or a solid state laser using a semiconductor laser as an excitation light source, a gas laser, a light-emitting diode, or a semiconductor laser. To make the system compact and inexpensive, it is preferable to use a semiconductor laser or a second harmonic generating light source (SHG) that comprises a combination of a nonlinear optical crystal with a semiconductor laser or a solid state laser. Particularly, to design an apparatus that is compact, inexpensive, long in life, and high in stability, the use of a semiconductor laser is preferable, and it is desired to use a semiconductor laser for at least one of the exposure light sources.

If such a scanning exposure light source is used, the spectral sensitivity maximum of the photographic material utilized in,the present invention can arbitrarily be set by the wavelength of the light source for the scanning exposure to be used. In an SHG light source obtained by combining a nonlinear optical crystal with a semiconductor laser or a solid state laser that uses a semiconductor laser as an excitation light source, since the emitting wavelength of the laser can be halved, blue light and green light can be obtained. Therefore, the spectral sensitivity maximum of the photographic material can be present in each of the blue region, the green region, and the red region. In order to use a semiconductor laser as a light source to make the apparatus inexpensive, high in stability, and compact, preferably each of at least two layers has a spectral sensitivity maximum at 670 nm or over. This is because the emitting wavelength range of the available, inexpensive, and stable III–V group semiconductor laser is present now only in from the red region to the infrared region. However, on the laboratory level, the oscillation of a II–VI group semiconductor laser in the green or blue region is confirmed and it is highly expected that these semiconductor lasers can be used inexpensively and stably if production technique for the semiconductor lasers is developed. In that event, the necessity that each of at least two layers has a spectral sensitivity maximum at 670 nm or over becomes lower.

In such scanning exposure, the time for which the silver halide in the photographic material is exposed is the time for which a certain very small area is required to be exposed. As the very small area, the minimum unit that controls the quantity of light from each digital data is generally used and is called a picture element. Therefore, the exposure time per picture element is changed depending on the size of the picture element. The size of the picture element is dependent on the density of the picture element, and the actual range is from 50 to 2,000 dpi. If the exposure time is defined as the time for which a picture element size is exposed with the density of the picture element being 400 dpi, preferably the exposure time is $10^{-4}$ sec or less, more preferably $10^{-6}$ sec or less. Further, preferably the exposure time is $10^{-10}$ to $10^{-4}$ sec, more preferably $10^{-9}$ to $10^{-6}$ sec.

In the photographic material according to the present invention, for the purpose of preventing irradiation or halation or of improving, for example, safelight immunity, preferably a dye, which can be decolored by processing (in particular, an oxonol dye or a cyanine dye), as described in European Patent EP 0337490A2, pages 27 to 76, is added to the hydrophilic colloid layer.

Some of these water-soluble dyes deteriorate the color separation or the safelight immunity if the amount thereof to be used is increased. As a dye that can be used without deteriorating the color separation, a water-soluble dye described in Japanese Patent Application No. 310143/1991, 310189/1991, or 310139/1991 is preferable.

In the present invention, instead of or in combination with the water-soluble dye, a colored layer capable of being decolored by processing is used. The colored layer used that can be decolored by processing may be arranged in contact with the emulsion layer directly or through an intermediate layer containing a processing color-mix inhibitor, such as gelatin and hydroquinone. This colored layer is preferably located under the emulsion layer (on the side of the support) that will form a primary color which is the same as that of the colored layer. Colored layers corresponding to respective primary colors may all be arranged, or only some of them may be arbitrarily selected and arranged. A colored layer that has been colored to correspond to several primary color regions can also be arranged. The optical reflection density of the colored layer is preferably such that the value of the optical density at the wavelength at which the optical density is highest in the wavelength region used for the exposure (in the visible light region of 400 nm to 700 nm in a usual printer exposure and in the wavelength of the scanning exposure light source to be used in the case of scanning exposure) is 0.2 or higher but 3.0 or lower, more preferably 0.5 or higher but 2.5 or lower, and particularly preferably 0.8 or higher but 2.0 or lower.

To form the colored layer, conventionally known methods can be applied. For instance, a method wherein a dye described in JP-A No. 282244/1990, page 3 (the right upper column) to page 8, or a dye described in JP-A No. 7931/1991, page 3 (the right upper column) to page 11 (the left lower column), is brought into the form of a solid fine particle dispersion and is allowed to be contained in a hydrophilic colloid layer; a method wherein an anionic dye is fixed to a cationic polymer; a method wherein a dye is adsorbed to fine particles, for example, of a silver halide and is fixed into a layer; or a method wherein colloidal silver is used as described in JP-A No. 239544/1989; can be mentioned. As the method for dispersing a fine powder of a dye in the solid state, for example, a method is described in JP-A No. 308244/1990, pages 4 to 13, wherein a fine powder dye, which is substantially insoluble in water at a pH of at least 6 or below, but which is substantially soluble in water at a pH of at least 8 or over, is incorporated. Further, a method wherein an anionic dye is fixed to a cationic polymer is described in JP-A No. 84637/1990, pages 18 to 26. Methods for preparing colloidal silver as a light-absorbing agent are described in U.S. Pat. Nos. 2,688,601 and 3,459,563. Out of these methods, the method wherein a fine powder dye is incorporated, and the method wherein colloidal silver is used, are preferred.

As a binder or protective colloid that can be used in the photographic material according to the present invention, gelatin is advantageously used, but some other hydrophilic colloid can bemused alone or in combination with gelatin. As a gelatin, preferably low-calcium gelatin having a calcium content of 800 ppm or less, more preferably 200 ppm or less, is used. In order to prevent various fungi or bacteria from propagating in the hydrophilic colloid layer to deteriorate the image quality, preferably a mildew-proofing agent, as described in JP-A No. 271247/1988, is added.

When the photographic material utilized in the present invention is subjected to printer exposure, preferably a band strip filter described in U.S. Pat. No. 4,880,726 is used. Thus, light color mixing is eliminated and color reproduction is remarkably improved.

An exposed photographic material can be subjected to conventional color development processing, and, in the case of the color photographic material utilized in the present invention, to make the processing rapid, preferably after it is color-developed, it is bleach-fixed. Particularly, when the above high-silver-chloride emulsion is used, the pH of the bleach-fix solution is preferably about 6.5 or below, more preferably 6 or below, for the purpose, for example, of accelerating desilvering.

As the silver halide emulsion to be applied to the photographic material utilized in the present invention and the other materials (e.g., additives) and the photographic constitutional layers (including the arrangement of the layers) to be applied thereto and the processing method and additives used in the processing of the photographic material utilized in the present invention, those described in the below-mentioned patent gazettes, particularly in European Patent EP 0,355,660A2 (JP-A No. 139544/1990), are preferably used.

| Element constituting photograpic material | JP-A No. 215272/1987 | JP-A No. 33144/1990 | EP 0,355,660A2 |
|---|---|---|---|
| Silver halide emulsion | p. 10 upper right column line 6 to p. 12 lower left column line 5, and p. 12 lower right column line 4 from the bottom to p. 13 upper left column line 17 | p. 28 upper right column line 16 to p. 29 lower right column line 11 and p. 30 lines 2 to 5 | p. 45 line 53 to p. 47 line 3 and p. 47 lines 20 to 22 |
| Solvent for silver halide | p. 12 lower left column lines 6 to 14 and p. 13 upper left column line 3 from the bottom to p. 18 lower left column last line | — | — |
| Chemical sensitizing agent | p. 12 lower left column line 3 from the bottom to lower right column line 5 from the bottom and p. 18 lower right column line 1 to p. 22 upper right column line 9 from the bottom | p. 29 lower right column line 12 to last line | p. 47 lines 4 to 9 |
| Spectral sensitizing agent (method) | p. 22 upper right column line 8 from the bottom to p. 38 last line | p. 30 upper left column lines 1 to 13 | p. 47 lines 10 to 15 |
| Emulsion stabilizer | p. 39 upper left column line 1 to p. 72 upper right column last line | p. 30 upper left column line 14 to upper right column line 1 | p. 47 lines 16 to 19 |
| Developing accelerator | p. 72 lower left column line 1 to p. 91 upper right column line 3 | — | — |
| Color coupler (Cyan, Magenta, and Yellow coupler) | p. 91 upper right column line 4 to p. 121 upper left column line 6 | p. 3 upper right column line 14 to p. 18 upper left column last line and p. 30 upper right column line 6 to p. 35 lower right column line 11 | p. 4 lines 15 to 27, p. 5 line 30 to p. 28 last line, p. 45 lines 29 to 31 and p. 47 line 23 to p. 63 line 50 |
| Color Formation-strengthen agent | p. 121 upper left column line 7 to p. 125 upper right column line 1 | — | — |
| Ultraviolet absorbing agent | p. 125 upper right column line 2 to p. 127 lower left column last line | p. 37 lower right column line 14 to p. 38 upper left column line 11 | p. 65 lines 22 to 31 |
| Discoloration inhibitor (Image-dye stabilizer) | p. 127 lower right column line 1 to p. 137 lower left column line 8 | p. 36 upper right column line 12 to p. 37 upper left column line 19 | p. 4 line 30 to p. 5 line 23, p. 29 line 1 to p. 45 line 25 p. 45 lines 33 to 40 and p. 65 lines 2 to 21 |
| High-boiling and/or low-boiling solvent | p. 137 lower left column line 9 to p. 144 upper right column last line | p. 35 lower right column line 14 to p. 36 upper left column line 4 from the bottom | p. 64 lines 1 to 51 |
| Method for dispersing additives for photograph | p. 144 lower left column line 1 to p. 146 upper right column line 7 | p. 27 lower right column line 10 to p. 28 upper left column last line and p. 35 lower right column line 12 to p. 36 upper right column line 7 | p. 63 line 51 to p. 64 line 56 |

-continued

| Element constituting photograpic material | JP-A No. 215272/1987 | JP-A No. 33144/1990 | EP 0,355,660A2 |
|---|---|---|---|
| Film Hardener | p. 146 upper right column line 8 to p. 155 lower left column line 4 | — | — |
| Developing Agent precursor | p. 155 lower left column line 5 to p. 155 lower right column line 2 | — | — |
| Compound releasing development inhibitor | p. 155 lower right column lines 3 to 9 | — | — |
| Support | p. 155 lower right column line 19 to p. 156 upper left column line 14 | p. 38 upper right column line 18 to p. 39 upper left column line 3 | p. 66 line 29 to p. 67 line 13 |
| Constitution of photo-sensitive layer | p. 156 upper left column line 15 to p. 156 lower right column line 14 | p. 28 upper right column lines 1 to 15 | p. 45 lines 41 to 52 |
| Dye | p. 156 lower right column line 15 to p. 184 lower right column last line | p. 38 upper left column line 12 to upper right column line 7 | p. 66 lines 18 to 22 |
| Color-mix inhibitor | p. 185 upper left column line 1 to p. 188 lower right column line 3 | p. 36 upper right column lines 8 to 11 | p. 64 line 57 to p. 65 line 1 |
| Gradation controller | p. 188 lower right column lines 4 to 8 | — | — |
| Stain inhibitor | p. 188 lower right column line 9 to p. 193 lower right column line 10 | p. 37 upper left column last line to lower right column line 13 | p. 65 line 32 to p. 66 line 17 |
| Surface-active agent | p. 201 lower left column line 1 to p. 210 upper right column last line | p. 18 upper right column line 1 to p. 24 lower right column last line and p. 27 lower left column line 10 from the bottom to lower right column line 9 | — |
| Fluorine-containing agent (As Antistatic agent, coating aid, lubricant, adhesion inhibitor, or the like) | p. 210 lower left column line 1 to p. 222 lower left column line 5 | p. 25 upper left column line 1 to p. 27 lower right column line 9 | — |
| Binder (Hydrophilic colloid) | p. 222 lower left column line 6 to p. 225 upper left column last line | p. 38 upper right column lines 8 to 18 | p. 66 lines 23 to 28 |
| Thickening agent | p. 225 upper right column line 1 to p. 227 upper right column line 2 | — | — |
| Antistatic agent | p. 227 upper right column line 3 to p. 230 upper left column line 1 | — | — |
| Polymer latex | p. 230 upper left column line 2 to p. 239 last line | — | — |
| Matting agent | p. 240 upper left column line 1 to p. 240 upper right column last line | — | — |
| Photographic processing method (processing process, additive, etc.) | p. 3 upper right column line 7 to p. 10 upper right column line 5 | p. 39 upper left column line 4 to p. 42 upper left column last line | p. 67 line 14 to p. 69 line 28 |

Note:
In the cited part of JP-A No. 215272/1987, amendment filed on March 16, 1987 is included. Further, among the above-mentioned couplers, it is preferred to use so called short wavelength-type yellow coupler, described in JP-A Nos. 231451/1988, 123047/1988, 241547/1988, 173499/1989, 213648/1989, and 250944/1989, as a yellow coupler.

Preferably, the cyan, magenta, and yellow couplers are impregnated into loadable latex polymers (e.g., loadable latex polymers described in U.S. Pat. No. 4,203,716) in the presence or absence of a high-boiling organic solvent listed in the above table, or they are dissolved together with water-insoluble and organic solvent-soluble polymers and are emulsified and dispersed into hydrophilic colloid aqueous solution. As water-insoluble and organic solvent-soluble polymers that can be preferably used, homopolymers or copolymers described in U.S. Pat. No. 4,857,449, the seventh column to the fifteenth column, and in International Publication No. WO 88/00723, pages 12 to 30, can be mentioned. More preferably, methacrylate-type polymers or acrylamide-type polymers, particularly acrylamide-type polymers, are used in view of color image stability and the like.

In the photographic material according to the present invention, color image preservability improving compounds as described in European Patent EP 0277589A2 are preferably used together with couplers, particularly, together with pyrazoloazole couplers and pyrrolotriazole couplers.

That is, the use of a compound described in the above-mentioned patent specifications that combines with the aromatic amine developing agent remaining after the color development processing to form a chemically inactive and substantially colorless compound and/or a compound described in the above-mentioned patent specifications that combines with the oxidized product of the aromatic amine color developing agent remaining after the color development processing to form a chemically inactive and substantially colorless compound simultaneously or singly is preferable. This is because, for example, the occurrence of stain or other side effects due to the formation of color formed dyes by the reaction of the color developing agent or its oxidized product remaining in the film during the storage after the processing with couplers can be prevented.

Further, as the cyan couplers, in addition to diphenylimidazole cyan couplers described in JP-A No. 33144/1990, 3-hydroxypyridine cyan couplers described in European Patent EP 0333185A2 (particularly, that formed by attaching a chlorine coupling-off group to the 4-equivalent coupler of Coupler (42) to make it to be 2-equivalent and Couplers (6) and (9) which are listed as specific examples are preferable), cyclic active methylene cyan couplers described in JP-A No. 32260/1989 (particularly Coupler Examples 3, 8, and 34 that are listed as specific examples are preferable), pyrrolopyrazole cyan couplers described in European Patent EP 0456226A1, pyrroloimidazole cyan couplers described in European Patent EP 0484909, and pyrrolotirazole cyan couplers described in European Patents EP 0488248 and EP 0491197A1 are preferably used. Among them, pyrrolotriazole cyan couplers are particularly preferably used.

As the yellow couplers, in addition to the compounds listed in the above table, acylacetamide yellow couplers whose acyl group has a 3- to 5-membered cyclic structure described in European Patent EP 0447969A1, malondianilide yellow coupler having a cyclic structure described in European Patent EP 0482552A1, and acylacetamide yellow couplers having a dioxane structure described in U.S. Pat. No. 5,118,599 are preferably used. Among them, acylacetamide yellow couplers whose acyl group is a 1-alkylcyclopropane-1-carbonyl group and malondianilide yellow couplers wherein one of the anilide constitutes an indoline ring are preferably used. These couplers can be used alone or in combination.

As the magenta couplers used in the present invention, 5-pyrazolone magenta couplers and pyrazoloazole magenta couplers as described in the known literature shown in the above table are used, but in particular, in view, for example, of the hue, the stability of images, and the color forming properties, pyrazolotriazole couplers wherein a secondary or tertiary alkyl group is bonded directly to the 2-, 3-, or 6-position of the pyrazolotriazole ring as described in JP-A No. 65245/1986, pyrazoloazole couplers containing a sulfonamido group in the molecule as described in JP-A No. 65246/1986, pyrazoloazole couplers having an alkoxyphenylsulfonamido ballasting group as described in JP-A No. 147254/1986, and pyrazoloazole couplers having an alkoxy group or an aryloxy group in the 6-position as described in European Patent Nos. 226,849A and 294,785A are preferably used.

As the processing method of color photographic material utilized in the present invention, besides methods described in the above-described table, processing materials and processing method described in JP-A No. 207250/1990, p.26 (right lower column line 1) to p.34 (right upper column line 9) and in JP-A No. 97355/1992, p.5 (left upper column line 17) to p.18 (right lower column line 20) are preferable.

Color materials and processing methods for use in the present invention will be described in detail. In the present invention, the photographic material is subjected to a color developing, desilvering, and water-washing or stabilizing process. The color developer to be used in the present invention contains known aromatic primary amine color-developing agent. Preferred examples are p-phenylene-diamine derivatives, and as representative examples thereof can be mentioned N,N-diethyl-p-phenylenediamine, 4-amino-N,N-diethyl-3-methylaniline, 4 -amino-N-(β-hydroxyethyl)-N-methylaniline, 4-amino-N-ethyl-N-(β-hydroxyethyl)aniline, 4-amino-N-ethyl-N-(β-hydroxyethyl)-3-methylaniline, 4-amino-N-ethyl-N-(3-hydroxypropyl)-3-methylaniline, 4-amino-N-ethyl-N-(4-hydroxybutyl)-3-methylaniline, 4-amino-N-ethyl-N-(β-methanesulfonamidoethyl)-3-methylaniline, 4-amino-N-ethyl-N-ethyl- 3-(β-hydroxyethyl)aniline, 4-amino-N-ethyl-N-(β-methoxyethyl)-3-methylaniline, 4-amino-N-(β-ethoxyethyl)-N-ethyl- 3-methylaniline, 4-amino-N-(3-carbamoylpropyl)-N-n-propyl- 3-methylaniline, 4-amino-N-(3-carbamoylbutyl)-N-n-propyl- 3-methylaniline, N-(4-amino-3-methylphenyl)-3-hydroxypyrrolidine, N-(4-amino-3-methylphenyl)-3-(hydroxymethyl)pyrrolidine, and N-(4-amino-3 -methylphenyl)-3-pyrrolidinecarboxyamide.

Among the above-described p-phenylenediamine derivatives, 4-amino-N-ethyl-N-(β-methanesulfonamidoethyl)-3-methylaniline, 4-amino-N-ethyl-N-(3 -hydroxypropyl)-3-methylaniline, and 4-amino-N-ethyl-N-(4 -hydroxybutyl)-3-methylaniline are preferable.

Examples of preferable compound are shown below, but the invention is not limited to them.

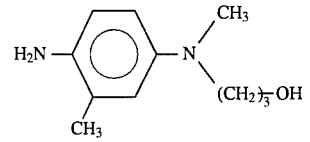
(I-1)

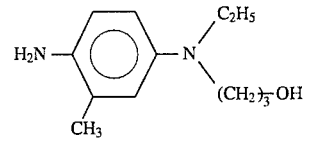
(I-2)

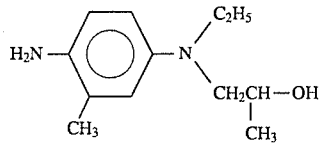
(I-3)

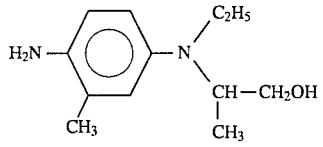
(I-4)

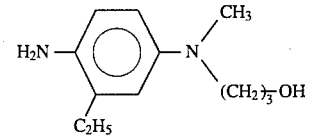
(I-5)

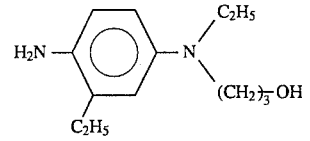
(I-6)

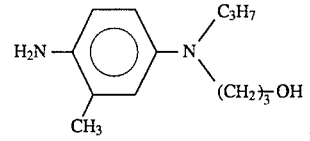
(I-7)

-continued

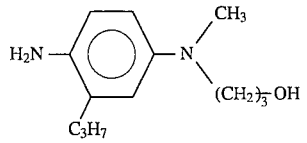
(I-8)

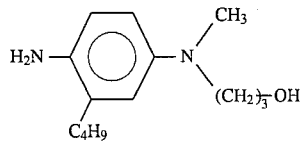
(I-9)

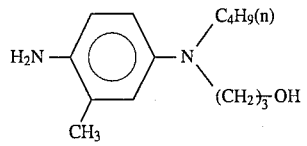
(I-10)

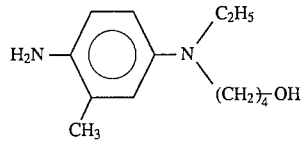
(I-12)

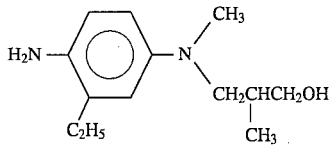
(I-13)

The most preferable compounds are 4-amino-N-ethyl-N-( 3-hydroxypropyl)-3-methylaniline and 4-amino-N-ethyl-N-( 4-hydroxybutyl)-3-methylaniline.

These p-phenylenediamine derivatives may be in the form of salts such as sulfates, hydrochloride, sulfites, naphtalene-disulfonates, and p-toluenesulfonates. The amount of said aromatic primary amine developing agent to be used is preferably about 0.002 to 0.2 mol, more preferably 0.005 to 0.1 mol, per liter of color developer.

When a replenishing parts of developing agent of the color developer is stored at a low pH, such as pH 2 to 6, the salt of sulfinic acid shown below is preferably used. The amount of sulfinate contained in the low-pH replenishing solution may be 0.001 to 0.1 mol, preferably 0.002 to 0.2 mol, per liter of the replenishing solution. Specified compound of salt of sulfinic acid

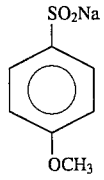
(S-1)

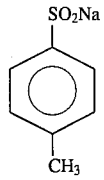
(S-2)

-continued

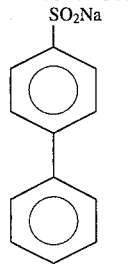
(S-3)

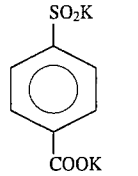
(S-4)

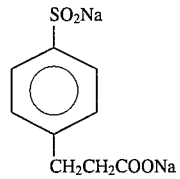
(S-5)

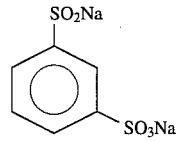
(S-6)

In practicing the present invention, remarkable effects can be attained in the case of using a color developer substantially free from benzyl alcohol. Herein the term "substantially free from" means that the concentration of benzyl alcohol is preferably 2.0 ml/l or below, more preferably 0.5 ml/l or below, and most preferably benzyl alcohol is not contained at all.

It is more preferable that the color developer for use in this invention is substantially free from sulfite ions (herein "substantially free from" means that the concentration of sulfite ions is $3.0\times10^{-3}$ mol/l or below), in order to suppress the variation of photographic properties due to the continuous processing and to attain the effects of the invention more remarkably. Preferably the concentration of sulfite ions is $1.0\times10^{-3}$ mol/l or below, and most preferably sulfite ion is not contained at all. However, in the present invention, a little amount of sulfite ions contained in a processing agents kit wherein the developing agent has been concentrated before preparing solution to be used, in order to prevent the oxidation of agents, is excluded.

Further, the color developer to be used in the present invention is more preferably substantially free from hydroxylamine (herein "substantially free from hydroxylamine" means that the concentration of hydroxylamine is $5.0\times10^{-3}$ mol/l or below), in order to suppress the variation of photographic properties due to the changing of concentration of hydroxylamine. Most preferably hydroxylamine is not contained at all.

It is more preferable that the color developer to be used in the present invention contains an organic preservative instead of above-described hydroxylamine or sulfite ions.

Herein the term "organic preservative" refers to organic compounds that generally, when added to the processing solution for the color photographic material, reduce the speed of deterioration of the aromatic primary amine color-developing agent. That is, organic preservatives include organic compounds having a function to prevent the color developing agent from being oxidized, for example, with air, and in particular, hydroxylamine derivatives (excluding hydroxylamine, hereinafter the same being applied), hydroxamic acids, hydrazines, hydrazides, phenols, α-hydroxyketones, α-aminoketones, saccharides, monoamines, diamines, polyamines, quaternary ammonium salts, nitroxy radicals, alcohols, oximes, diamide compounds, and condensed cyclic amines are effective organic preservatives. These are disclosed, for example, in JP-B No. 30496/1973, JP-A Nos. 143020/1977, 4235/1988, 30845/1988, 21647/1988, 44655/1988, 53551/1988, 43140/1988, 56654/1988, 58346/1988, 43138/1988, 146041/1988, 44657/1988, and 44656/1988, U.S. Pat. Nos. 3,615,503 and 2,494,930, and JP-A Nos. 97953/1989, 186939/1989, 186940/1989, 187557/1989, and 306244/1990. As the other preservative, various metals described in JP-A Nos. 44148/1982 and 53749/1982, salicylic acids described in JP-A No. 180588/1984, amines described in JP-A Nos. 239447/1988, 128340/1988, 186939/1989, and 187557/1989, alkanolamines described in JP-A No. 3532/1979, polyethyleneimines described in JP-A No. 94349/1981, aromatic polyhydroxyl compounds described in U.S. Patent. No. 3,746,544 maybe included, if needed. It is particularly preferable the addition of alkanolamines, such as triethanolamine, dialkylhydroxylamines, such as N,N-diethylhydroxylamine and N,N-di(sulfoethyl)hydroxylamine, hydrazine derivatives (excluding hydrazine), such as N,N-bis(carboxymethyl)hydrazine, or aromatic polyhydroxyl compounds, such as sodium catechol-3,5-disulfonate.

In particular, the use of alkanolamines in combination with dialkylhydroxylamine and/or hydrazine derivatives is more preferable in view of stability improvement of the color developer resulting its stability improvement during the continuous processing.

In the present invention, the color developer preferably contains bromide ions in an amount of $0.5\times10^{-5}$ to $1.0\times10^{-3}$ mol/l, more preferably $3.0\times10^{-5}$ to $5\times10^{-4}$ mol/l. When the concentration of bromide ions is too high, developing is retarded, resulting maximum density and sensitivity being lowered, and when the concentration is too low, fogging cannot be prevented sufficiently.

Herein, chloride ions and bromide ions may be added directly to the color developer, or they may be allowed to dissolve out from the photographic material in the color developer at the development processing.

If chloride ions are added directly to the color developer, as the chloride ion-supplying material can be mentioned sodium chloride, potassium chloride, ammonium chloride, lithium chloride, magnesium chloride, and calcium chloride. Further, they may be supplied from a fluorescent brightening agent that is added to the color developer.

As the bromide ion-supplying material can be mentioned sodium bromide, potassium bromide, ammonium bromide, lithium bromide, calcium bromide, and magnesium bromide.

When chloride ions and bromide ions are allowed to dissolve out from the photographic material in the color developer, both the chloride ions and bromide ions may be supplied from the emulsion or a source other than the emulsion.

Preferably the pH of the color developer to be used in the present invention is in the range of 9 to 12, more preferably 9 to 11.0, and other known compounds that are components of a conventional developing solution can be contained in the color developing solution.

In order to keep the above pH, it is preferable to use various buffers. As buffers, use can be made, for example, carbonates, phosphates, borates, tetraborates, hydroxylbenzoates, glycyl salts, N,N-dimethylglycinates, leucinates, norleucinates, guanine salts, 3,4-dihydroxyphenylalanine salts, alanine salts, aminobutyrates, 2 -amino-2-methyl-1,3-propandiol salts, valine salts, proline salts, trishydroxyaminomethane salts, and lysine salts. It is particularly preferable to use carbonates, phosphates, tetraborates, and hydroxybenzoates as buffers, because they have advantages that they are excellent in solubility and in buffering function in the high pH range of a pH 9.0 or higher, they do not adversely affect the photographic function (for example, to cause fogging), and they are inexpensive.

As specified examples of buffer, there are included sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). However, the present invention is not limited to these compounds.

The amount of buffer to be added to the color developer is preferably 0.1 mol/l or more, and particularly preferably 0.1 to 0.4 mol/l.

In addition, to the color developer can be added various chelating agents to prevent calcium or magnesium from precipitating or to improve the stability of the color developer. Specific examples are shown below: nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid, transcyclohexanediaminetetraacetic acid, 1,2-diaminopropanetetraacetic acid, glycol ether diaminetetraacetic acid, ethylenediamineorthohydroxyphenylacetic acid, 2-phosphonobutane-1,2,4-tricarboxylic acid, 1 -hydroxyethylidene-1,1-diphosphonic acid, N,N'-bis(2 -hydroxybenzyl)ethylenediamine-N,N'-diacetic acid, hydroxyethyliminodiacetic acid. If necessary, two or more of these chelating agents may be used together.

With respect to the amount of these chelating agents to be added, it is good if the amount is enough to sequester metal ions in the color developer. The amount, for example, is on the order of 0.1 g to 10 g per liter.

If necessary, any development accelerator can be added to the color developer.

As development accelerators, the following can be added as desired: thioether compounds disclosed, for example, in JP-B Nos. 16088/1962, 5987/1962, 7826/1963, 12380/1969, and 9019/1970, and U.S. Pat. No. 3,813,247; p-phenylenediamine compounds disclosed in JP-A Nos. 49829/1977 and 15554/1975; quaternary ammonium salts disclosed, for example, in JP-A No. 137726/1975, JP-B No. 30074/1969, and JP-A Nos. 156826/1981 and 43429/1977; amine compounds disclosed, for example, in U.S. Pat. Nos. 2,494,903, 3,128,182, 4,230,796, and 3,253,919, JP-B No. 11431/1966, and U.S. Pat. Nos. 2,482,546, 2,596,926, and 3,582,346; polyalkylene oxides disclosed, for example, in JP-B Nos. 16088/1962 and 25201/1967, U.S. Pat. No. 3,128,183, JP-B Nos. 11431/1966 and 23883/1967, and U.S. Pat. No. 3,532,501; 1-phenyl-3-pyrazolidones, and imidazoles.

In the present invention, if necessary, any antifoggant can be added. As antifoggants, use can be made of alkali metal halides, such as sodium chloride, potassium bromide, and potassium iodide, and organic antifoggants. As typical organic antifoggants can be mentioned, for example, nitrogen-containing heterocyclic compounds, such as benzotriazole, 6-nitrobenzimidazole, 5-nitroisoindazole, 5-methylbenzotriazole, 5-nitrobenzotriazole, 5-chloro-benzotriazole, 2-thiazolylbenzimidazole, 2-thiazolylmethyl-benzimidazole, indazole, hydroxyazaindolizine, and adenine.

It is preferable that the color developer that is adaptable in the present invention contains a fluorescent brightening agent. As the fluorescent brightening agent, 4,4'-diamino-2,2'-disulfostilbene compounds are preferable, which will be added in an amount of 0 to 5 g/l, preferably 0.1 to 4 g/l.

If required, various surface-active agents, such as alkylsulfonic acids, arylsulfonic acids, aliphatic carboxylic acids, aromatic carboxylic acids, and polyalkyleneimines may be added.

With respect to the color developer utilized in the present invention, for details other than the above described those of a usual color developer can be adapted.

The processing temperature of the color developer adaptable to the present invention is 20° to 50° C., preferably 30° to 45° C., and most preferably 37° to 42° C. The processing time is 5 sec to 2 min, and preferably 10 sec to 1 min. Although it is preferable that the replenishing amount is as small as possible, it is suitable that the replenishing amount is 20 to 600 ml, preferably 30 to 200 ml, more preferably 40 to 100 ml, per $m^2$ of the photographic material.

The photographic material is generally subjected to a desilvering process after color development. The desilvering process can be carried out by conducting a bleaching process and a fixing process, separately, or carried out by conducting a bleaching process and a fixing process at the same time (bleach-fixing process). Further, to quicken the process bleach-fixing may be carried out by after the bleaching process. In accordance with the purpose, the process may be arbitrarily carried out using a bleach-fixing bath having two successive tanks, or a fixing process may be carried out before the bleach-fixing process, or a bleaching process may be carried out after the bleach-fixing process.

As the bleaching agent to be used in a bleaching solution and a bleach-fixing solution, use can be made of, for example, iron salts, compounds of polyvalent metals, such as iron (III), cobalt (III), chromium (IV), and copper (II), peracids, quinones, and nitro compounds. As typical bleaching agents, use can be made of iron chlorides, ferricyanides dichromates, organic complex salts of iron (III) (e.g., complex salts of aminopolycarboxylic acid such as ethylenediaminetetraacetic acid, diethylenetriaminepentaacetic acid, cyclohexanediaminetetraacetic acid, methyliminodiacetic acid, 1,3-diaminopropanetetraacetic acid, and glycoletherdiaminetetraacetic acid), persulfates, bromates, permanganates, and nitrobenzenes. Of these, aminopolycarboxylic acid complex salts of iron (III), including ethylenediaminetetraacetic acid iron (III) complex salts and 1,3-diaminopropanetetraacetic acid iron (III) complex salts are preferable in view of the rapid processing and the prevention of environmental pollution. Further, aminopolycarboxylic acid iron (III) complex salts are particularly useful in a bleaching solution as well as a bleach-fix solution. The bleaching solution or the bleach-fix solution using these aminopolycarboxylic acid iron (III) complex salts is generally used in pH 3 to 8.

Known additives, for example, a rehalogenating agent such as ammonium bromide and ammonium chloride, a pH buffer such as ammonium nitrare, and a metal-corrosion-preventing agent such as ammonium sulfate can be added in the bleaching solution or the bleach-fix solution.

In addition to the above-described compounds, an organic acid is preferably contained in the bleaching solution and the bleach-fix solution to prevent bleach stain. Particularly preferable organic acids include compounds having an acid dissociation constant (pKa) of 2 to 5.5, and specifically acetic acid and propionic acid are preferable.

Although as the fixing agents to be used in the fixing solution and bleach-fix solution use can be made of thiosulfates, thiocyanates, thioether compounds, thioureas, and a large amount of iodide salts, the use of thiosulfate is general, particularly ammonium thiosulfate can be used most widely. Further, combination use of thiosulfate with thiocyanate, thioether compound, or thiourea is also preferable.

As a preservative for the fixing solution and the bleach-fixing solution, sulfites, bisulfites, carbonyl-bisulfic acid adduct or sulfonic acid compounds described in European Patent No. 294769A are preferable. Further, it is preferable to add various aminopolycarboxylic acids or organic phosphonic acids (e.g., 1-hydroxyethylidene-1,1-diphosphonic acid and N,N,N',N'-ethylenediaminetetraphosphonic acid) in the fixing solution and the bleach-fix solution for the purpose to stabilize the solution.

Further, in the fixing solution and the bleach-fixing solution, various fluorescent brightening agents, antifoamers, surface-active agents, poly(vinyl pyrrolidone), and methanol can be included.

In the bleaching solution, the bleach-fix solution, and bath preceding them, various compounds may be used as a bleach-accelerating agent, according to a need. As specific examples of useful bleach-accelerating agents, use can be made of, for example, compounds having a mercapto group or a disulfido group, described in U.S. Pat. No. 3,893,858, West German Patent No. 1,290,812, and JP-A No. 95630/1978, and *Research Disclosure* No. 17129 (July 1978), thiazolizine derivatives described in JP-A No. 140129/1975, thiourea derivatives described in U.S. Pat. No. 3,706,561, iodide salts described in JP-A No. 16235/1983, polyoxyethylene compounds described in West German Patent No. 2,748,430, polyamine compounds described in JP-B No. 8836/1970, and bromide ions. Among them, compounds having a mercapto group or disulfide group are preferable in view of large accelerating effect, in particular, compounds described in U.S. Pat. No. 3,893,858, West German Patent No. 1,290,812, and JP-A No. 95630/1978 are preferable, Further, the compound described in U.S. Pat. No. 4,552,834 is also preferable. These bleach-accelerating agents may be added in the photographic material. These bleach-accelerating agents are particularly effective for bleach-fixing a color photographic material for photography.

The shorter the total time of the desilver-processing step is, the more preferable it is within the range wherein silver retention does not occur. Preferably it is 5 sec to 25 sec, more preferably 10 sec to 20 sec. Herein the term the time of processing refers to the time interval when the photographic material is immersed into the processing solution. The processing temperature is 25° to 50° C., preferably 35° to 45° C. In the preferable temperature range, the desilvering speed is improved and occurrence of stain after the processing is effectively prevented.

The replenishing amount of bleach-fix solution is preferably 5 to 120 ml, more preferably 10 to 50 ml, per $m^2$ of the photographic material. The amount is preferably 0.5 to 3 times, particularly preferably 1 to 2 times, the carried over amount of developer.

In the desilvering step, preferably the stirring is enhanced as much as possible. Specific techniques for enhancing the stirring that can be mentioned include a method described in JP-A No. 183460/1987 or No. 183461/1987, wherein a jet of a processing liquid is caused to impinge upon the emulsion surface of a photographic material; a method described in JP-A No. 183461/1987, wherein a rotating means is used for increasing the stirring effect; a method wherein a photographic material is moved with a wiper blade provided in a liquid in contact with the emulsion surface, to make the liquid near the emulsion surface turbulent, thereby improving the stirring effect; and a method wherein the circulated flow rate of all the processing liquid is increased. Such a means of improving stirring is effective for any of a bleaching solution, a bleach-fix solution, and a fixing solution. It is considered that the improvement of stirring quickens the supply of a bleaching agent and a fixing agent into emulsion layers, and as a result the speed of desilvering is increased. Further when a bleach accelerator is used, the above means of improving stirring is more effective, increases the accelerating effect noticeably; and it can cancel the fixing-hindrance effect of the bleach accelerator.

The automatic processor to be used for the photographic material according to the present invention is preferably provided with a photographic material transporting means described in JP-A Nos. 191257/1985, 191258/1985, and 191259/1985. As is described in JP-A No. 191257/1985, such a transporting means can reduce considerably the carried over amount of the processing solution from a preceding bath to the succeeding bath, and it is high in the effect of preventing the performance of the processing solution from being deteriorated. Such an effect is particularly efficacious in shortening the processing time in each step and in reducing the replenishing amount of the processing solution.

The processing utilized in the present invention exhibits an excellent performance compared with combination methods other than the present invention at any state of opened surface ratio of processing solution. Herein, the opened surface ratio is represented as follows:

Opened surface ratio ($cm^{-1}$) =

(Contact surface area ($cm^2$) of the processing solution with the air)/

(Whole volume ($cm^3$) of the processing solution)

However, the opened surface ratio is preferably 0 to 0.1 $cm^{-1}$ in view of the stability of solution constituents. In the continuous processing, for a practical use, the opened surface ratio is preferably in the range from 0.001 to 0.05 $cm^{-1}$ more preferably in the range from 0.002 to 0.03 $cm^{-1}$.

Generally, the color photographic material utilized in the present invention is subjected to a washing step after the desilvering process. Instead of the washing step, a stabilizing step can be carried out. In such a stabilizing process, any of known methods described in JP-A Nos. 8543/1982, 14834/1983, and 220345/1985 can be used. A washing step/stabilizing step, wherein a stabilizing bath containing a dye stabilizer and a surface-active agent that is typically used for processing a photographing color photographic material is used as a final bath, can be carried out.

The washing solution and the stabilizing solution can contain a water softener, such as an inorganic phosphoric acid, polyaminocarbonic acid and an organic aminophosphonic acid; a metal salt such as an Mg salt, an Al salt, and a Bi salt; a surface-active agent; and a hardening agent.

The amount of washing water in the washing step can be set over a wide range, depending on the characteristics of the photographic material (e.g., the characteristics of the material used, such as couplers), the usage of the photographic material, the washing water temperature, the number of the washing water tanks (stages), the type of replenishing, such as the countercurrent type or of the down flow type, and other various conditions. Further, to solve such problems as the propagation of bacteria when the amount of washing water is decreased greatly at a multistage countercurrent flow system and the adhering of suspended matter to the photographic material, the method for reducing calcium ions and magnesium ions, described in JP-A No. 288838/1987, can be used quite effectively. Also, isothiazolone compounds and cyabendazoles described in JP-A No. 8542/1982, chlorine-type disinfectant such as chlorinated sodium isocyanurate, benzotriazoles, and other bactericides described by Hiroshi Horiguchi in *Bokin Bobai-zai no Kagaku*, (1986) published by Sankyo-Shuppan, *Biseibutsu no Mekkin, Sakkin, Bobaigijutsu* (1982) edited by Eiseigijutsu-kai, published by Kogyo-Gijutsu-kai, and in *Bokin Bobaizai Jiten* (1986) edited by Nihon Bokin Bobai-gakkai, can be used.

The pH of the washing water used in the washing step is 4 to 9, preferably 5 to 8. The washing water temperature and the washing time to be set may vary depending, for example, on the characteristics and the application of the photographic material, and they are generally selected in the range of 15° to 45° C. for 10 sec to 2 min, and preferably in the range of 25° to 40° C. for 15 to 45 sec.

As dye-stabilizing agents to be able to use in a stabilizing solution, aldehydes such as formalin and gultalaldehyde, N-methylol compounds, hexamethylenetetramine, and aldehyde-sulfic acid adduct can be mentioned. Further, the stabilizing solution can contain pH controlling buffer, such as boric acid and sodium hydride, 1-hydroxyethylidene-1, 1-diphosphonic acid, chelating agent, such as ethylenediaminetetraacettic acid, sulfulation-preventer, such as alkanolamine, fluorescent brightening agent, and antimold agent.

The over-flowed solution due to the above-mentioned replenishing of washing solution and/or stabilizing solution may be reused in other steps, such as a desilvering step.

In the processing using an automatic processor, it is preferable to correct the concentration of processing solution by adding water when concentration due to evaporation occurs.

In the present invention, a so-called jet-stream process can be carried out for water-washing solution and/or stabilizing solution, and/or any arbitrary processing solution. The stream can be generated by discharging the processing solution against the emulsion surface of photographic material through a nozzle or a slit provided at the position being opposite to the emulsion surface, which processing solution has been suctioned by a pump in the processing bath. More specifically, the method described in JP-A No. 183460/1987 p. 3 (lower right column) to p. 4 (lower right column), wherein the solution pressed and forwarded by a pump is discharged through a slit or a nozzle provided so as to be opposite to the emulsion surface.

In the present invention, an washing water and/or a stabilizing water treated by a reverse osmosis membrane can be used effectively. As the raw material of the reverse osmosis membrane, cellulose acetate, crosslinked polyamide, polyether, polysyllabic, polyacrylic acid, polyvinylenecarbonate, or the like can be used.

The pressure of solution to be used for such a membrane is preferably 2 to 10 $kg/cm^2$ more preferably 3 to 7 $kg/cm^2$ in view of preventing stain and decrease of amount of permeated solution.

The water-washing process and/or stabilizing process are preferably carried out in a multistage-countercurrent mode using multiple tanks, particularly preferably using 2 to 5 tanks.

The treatment by a reverse osmosis membrane is preferably conducted to the water after the second tank in said multistage countercurrent washing process and/or stabilizing process. Concretely, water in the second tank in a 2-tanks constitution, water in the second or third tank in a 3-tanks constitution, or water in the third or fourth tank in a 4-tanks constitution is treated by a reverse osmosis membrane, and the water permeated is returned to the same tank (from which tank water to be treated was withdrawn, hereinafter referred to as a withdrawing tank) or a tank afterward positioned in the washing and/or stabilizing process. Further, in one response to the reverse osmosis treatment, the concentrated washing solution and/or stabilizing solution are fed back to the preceding bleach-fix bath against the withdrawing tank.

In the method of the present invention, the total processing time from developing process to drying process both inclusive is preferably 120 sec or less, more preferably 90 to 30 sec. Herein "the total processing time" means a time interval between the time when the photographic material is immersed into a developer and the time when it comes out of the dryer part of processor.

The silver halide color photographic material utilized in the present invention may contain therein a color-developing agent for the purpose of simplifying and quickening the process. To contain such a color-developing agent, it is preferable to use a precursor for color-developing agent. For example, indoaniline-type compounds described in U.S. Pat. No. 3,342,597, Schiff base-type compounds described in U.S. Pat. No. 3,342,599 and *Research Disclosure* Nos. 14850 and 15159, aldol compounds described in *Research Disclosure* No. 13924, and metal salt complexes described in U.S. Pat. No. 3,719,492, and urethane-type compounds described in JP-A No. 1352628/1978 can be mentioned.

For the purpose of accelerating the color development, the silver halide color photographic material utilized in the present invention may contain, if necessary, various 1-phenyl-3-pyrazolidones. Typical compounds are described in JP-A Nos. 64339/1981, 144547/1982, and 115438/1983.

According to the present method, in the low-replenishing-rate rapid processing, particularly in the low-replenishing-rate processing in a desilvering step, the occurrence of stain during storage of an image can be minimized. As a result, even if the amount of waste liquor from the processing apparatus is reduced considerably, a high-quality color image, particularly a high-quality color print image, can be obtained.

Now the present invention will be described more specifically with reference to Examples, but the present invention is not restricted to the Examples.

EXAMPLE 1

(Preparation of a Support)

A mixed composition of titanium oxide (KA-10, manufactured by Titanium Kogyo) and a polyethylene or a polyester (having a limiting viscosity of 6.5) synthesized by condensation polymerization of a dicarboxylic acid compositions and ethylene glycol, shown in Table 1, was melted and mixed at 300° C. in a twin-screw mixing extruder and was melt-extruded through a T-die onto the surface of base paper having a thickness of 180 μm, thereby forming a laminated layer having a thickness of 30 μm. A calcium carbonate-containing polyester resin composition was melt-extruded at 300° C., to form a laminated layer having a thickness of 30 μm on the other surface of base paper. After the resin surface of this laminated reflective support on which an emulsion would be applied was subjected to a corona discharge treatment, a coating solution having the following composition was applied in an amount of 50 ml/m$^2$, followed by drying for 2 min at 80° C., to obtain photographic support Sample Nos. 101 to 104.

TABLE 1

| Support No. | Resin (Composition of dicarboxylic acid of polyester in molar ratio | $TiO_2$ (wt %) | Remarks |
|---|---|---|---|
| 101 | Polyester (Terephthalic acid 100) | 20 | This invention |
| 102 | Polyester (Terephthalic acid/ isophthalic acid: 90/10) | 20 | " |
| 103 | Polyester (Terephthalic acid/ Naphthalenedicarboxylic acid: 90/10) | 20 | " |
| 104 | Polyethylene | 15 | Comparative |

TABLE 1-continued

| | example |
|---|---|
| [Formulation of the undercoat] | |
| Compound ExU1 | 0.2 g |
| Compound ExU2 | 0.001 g |
| $H_2O$ | 35 ml |
| Methanol | 65 ml |
| Gelatin | 2 g |
| | pH 9.5 |

ExU1

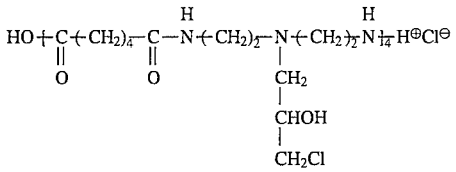

ExU2 $C_{12}H_{25}O(CH_2CH_2O)_{10}H$

The coating solutions were prepared as follows.

Preparation of the first layer coating solution 153.0 Grams of yellow coupler (ExY), 15.0 g of image-dye stabilizer (Cpd-1), 7.5 g of image-dye stabilizer (Cpd-2), 16.0 g of image-dye stabilizer (Cpd-3) were dissolved in 25 g of solvent (Solv-1), 25 g of solvent (Solv-2), and 180 ml of ethyl acetate, and the resulting solution was emulsified and dispersed in 1,000 ml of 10% aqueous gelatin solution containing 60 ml of 10% sodium dodecylbenzenesulfonate solution and 10 g of citric acid, thereby prepared emulsified dispersion A.

Separately silver chlorobromide emulsion A (cubic grains, 3:7 (silver molar ratio) blend of large size emulsion A having 0.88 μm of average grain size and small size emulsion A having 0.70 μm of average grain size, and 0.08 and 0.10 of deviation coefficient of grain size distribution, respectively, each in which emulsion 0.3 mol % of silver bromide was located at a part of grain surface, wherein other silver halide than silver bromide was silver chloride) was prepared. Blue-sensitive sensitizing dyes A and B, shown below, were added in amounts of dyes that corresponds to $2.0\times10^{-4}$ mol and $2.5\times10^{-4}$ mol to the large size emulsion A and small size emulsion A, per mol of silver, respectively. The chemical sensitizing of this emulsion was carried out by adding sulfur sensitizing agent and gold sensitizing agent.

The above-described emulsified dispersion A and this silver chlorobromide emulsion A were mixed together and dissolved to give the composition shown below, thereby preparing the first layer coating solution.

Preparation of coating solutions for the second to seventh layer:

Coating solutions for the second to seventh layers were also prepared in the same manner as the coating solution of first layer.

Photographic material samples (101 to 104) having respectively layer composition shown below on the above-prepared supports (101 to 104) were prepared by coating the above-described each layer coating solution.

As a gelatin hardener for the respective layers, 1-oxy-3, 5-dichloro-s-triazine sodium salt was used.

Further, Cpd-14 and Cpd-15 were added in each layer in such amounts that the respective total amounts become 25.0 mg/m$^2$ and 50.0 mg/m$^2$.

Spectral sensitizing dyes shown below were used in respective silver chlorobromide emulsions of photosensitive emulsion layers.

Blue-sensitive emulsion layer:

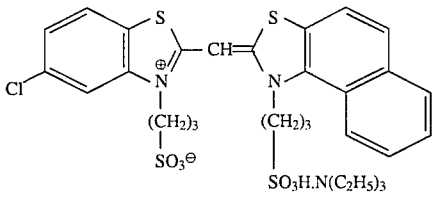

Sensitizing dye A and

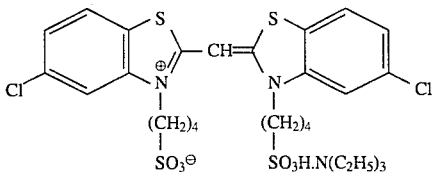

Sensitizing dye B (each $2.0 \times 10^{-4}$ mol to the large size emulsion and $2.5 \times 10^{-4}$ mol to the small size emulsion, per mol of silver halide.)

Green-sensitive emulsion layer:

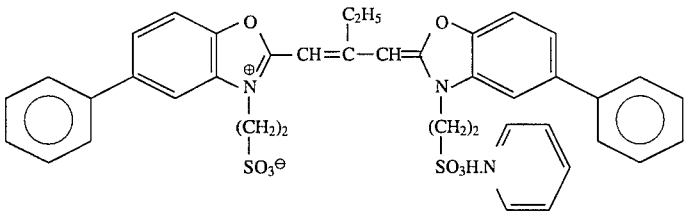

Sensitizing dye C ($4.0 \times 10^{-4}$ mol to the large size emulsion and $5.6 \times 10^{-4}$ mol to the small size emulsion, per mol of silver halide)

and

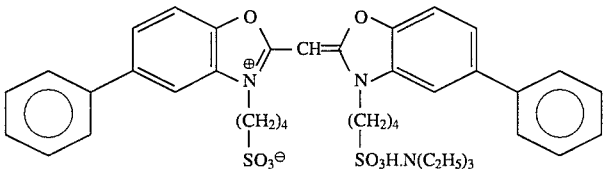

Sensitizing dye D ($7.0 \times 10^{-5}$ mol to the large size emulsion and $1.0 \times 10^{-5}$ mol to the small size emulsion, per mol of silver halide)

Red-sensitive emulsion layer:

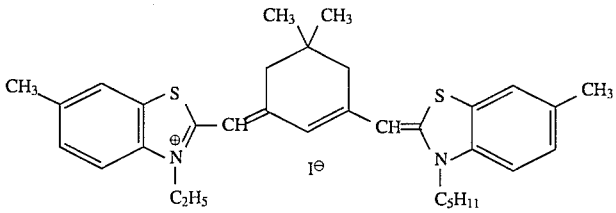

Sensitizing dye E ($0.9 \times 10^{-4}$ mol to the large size emulsion and $1.1 \times 10^{-4}$ mol to the small size emulsion, per mol of silver halide)

Further, the following compound was added in an amount of $2.6\times10^{-3}$ mol per mol of silver halide:

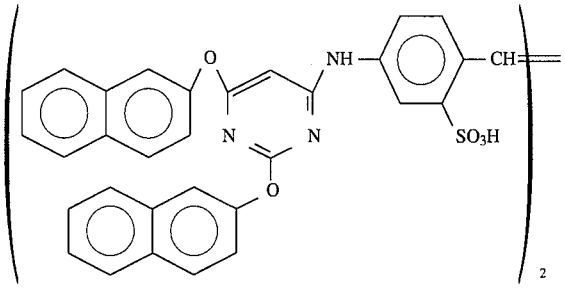

Further, 1-(5-methylureidophenyl)-5-mercaptotetrazole was added to the blue-sensitive emulsion layer, the green-sensitive emulsion layer, and the red-sensitive emulsion layer in amount of $8.5\times10^{-5}$ mol, $7.7\times10^{-4}$ mol, and $2.5\times10^{-4}$ mol, per mol of silver halide, respectively.

Further, 4-hydroxy-6-methyl-1,3,3a,7-tetrazaindene was added to the blue-sensitive emulsion layer and the green-sensitive emulsion layer in amount of $1\times10^{-4}$ mol and $2\times10^{-4}$ mol, per mol of silver halide, respectively.

The dyes shown below (figure in parentheses represents coating amount) were added to the emulsion layers for prevention of irradiation.

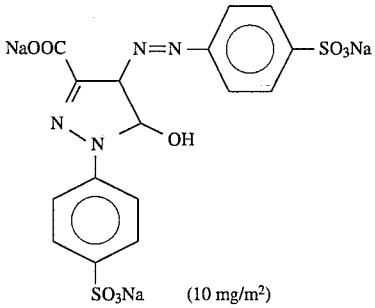

(10 mg/m²)

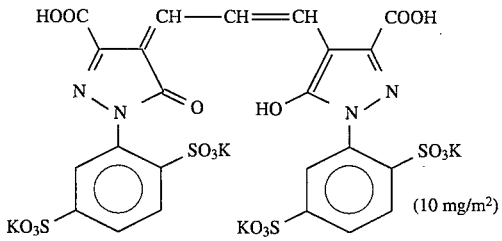

(10 mg/m²)

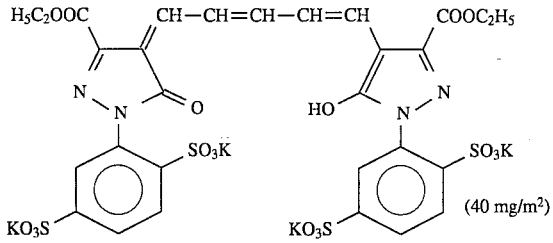

(40 mg/m²)

and

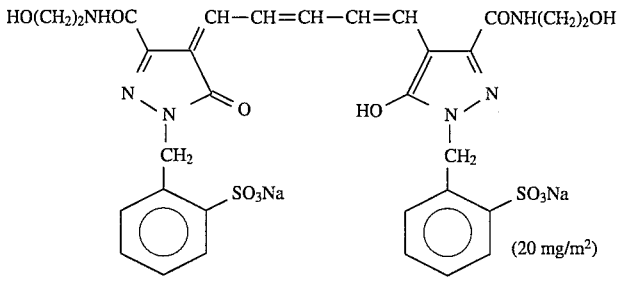

(20 mg/m²)

(Composition of Layers)

The composition of each layer of Sample 104 is shown below. The figures represent coating amount (g/m$^2$). The coating amount of each silver halide emulsion is given in terms of silver.

Support

Paper laminated with resin (in addition to the support No. 104 shown in Table 1 above, a bluish dye (ultra-marine) was added to the resin of the first layer side of the support)

| | |
|---|---|
| First Layer (Blue-sensitive emulsion layer) | |
| The above described silver chlorobromide emulsion A | 0.27 |
| Gelatin | 1.36 |
| Yellow coupler (ExY) | 0.79 |
| Image-dye stabilizer (Cpd-1) | 0.08 |
| Image-dye stabilizer (Cpd-2) | 0.04 |
| Image dye stabilizer (Cpd-3) | 0.08 |
| Solvent (Solv-1) | 0.13 |
| Solvent (Solv-2) | 0.13 |
| Second Layer (Color-mix preventing layer) | |
| Gelatin | 1.00 |
| Color-mix inhibitor (Cpd-A) | 0.04 |
| Color-mix inhibitor (Cpd-B) | 0.04 |
| Solvent (Solv-2) | 0.16 |
| Solvent (Solv-3) | 0.08 |
| Solvent (Solv-7) | 0.03 |
| Third Layer (Green-sensitive emulsion layer) | |
| Silver chlorobromide emulsion B (cubic grains, 1:3 (Ag molar ratio) blend of large size emulsion B having average grain size of 0.55 μm and small size emulsion B having average grain size of 0.39 μm, whose deviation coefficient of grain size distribution was 0.10 and 0.08, respectively, each in which emulsion 0.8 mol % of silver bromide was located at a part of grain surface, wherein silver halide other than above silver bromide was silver chloride) | 0.13 |
| Gelatin | 1.45 |
| Magenta coupler (ExM) | 0.26 |
| Image-dye stabilizer (Cpd-5) | 0.04 |
| Image-dye stabilizer (Cpd-2) | 0.02 |
| Image-dye stabilizer (Cpd-6) | 0.02 |
| Image-dye stabilizer (Cpd-8) | 0.03 |
| Solvent (Solv-8) | 0.30 |
| Solvent (Solv-9) | 0.15 |
| Fourth Layer (Color-mix preventing layer) | |
| Gelatin | 0.70 |
| Color-mix inhibitor (Cpd-A) | 0.03 |
| color-mix inhibitor (Cpd-B) | 0.03 |
| Solvent (Solv-2) | 0.11 |
| Solvent (Solv-3) | 0.06 |
| Solvent (Solv-7) | 0.02 |
| Fifth Layer (Red-sensitive emulsion layer) | |
| Silver chlorobromide emulsion C (cubic grains, 1:4 (Ag molar ratio) blend of large size emulsion C having average grain size of 0.50 μm and small size emulsion C having average grain size of 0.41 μm, whose deviation coefficient of grain size distribution was 0.09 and 0.11, respectively, each in which emulsion 0.8 mol % of silver bromide was located at a part of grain surface, wherein silver halide other than above silver bromide was silver chloride) | 0.18 |
| Gelatin | 0.80 |
| Cyan coupler (ExC) | 0.33 |
| Image-dye stabilizer (Cpd-1) | 0.35 |
| Ultraviolet absorber (UV-2) | 0.18 |
| Image-dye stabilizer (Cpd-9) | 0.15 |
| Image-dye stabilizer (Cpd-10) | 0.15 |
| Image-dye stabilizer (Cpd-11) | 0.01 |
| Solvent (Solv-6) | 0.22 |
| Image-dye stabilizer (Cpd-8) | 0.01 |
| Image-dye stabilizer (Cpd-6) | 0.01 |
| Solvent (Solv-1) | 0.01 |
| Sixth Layer (Ultraviolet absorbing layer) | |
| Gelatin | 0.55 |
| Ultraviolet absorber (UV-1) | 0.38 |
| Image-dye stabilizer (Cpd-12) | 0.15 |
| Image-dye stabilizer (Cpd-5) | 0.02 |
| Seventh Layer (Protective layer) | |
| Gelatin | 1.13 |
| Acryl-modified copolymer of polyvinyl alcohol (modification degree : 17%) | 0.05 |
| Liquid paraffin | 0.02 |

-continued
| | |
|---|---|
| Image-dye stabilizer (Cpd-13) | 0.01 |
(ExY) Yellow coupler
Mixture ((a):(b) = 1:1 in molar ratio) of
(a) R = 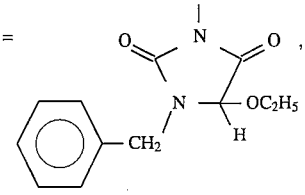
(b) R = 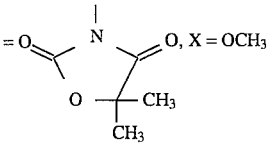
of the following formula
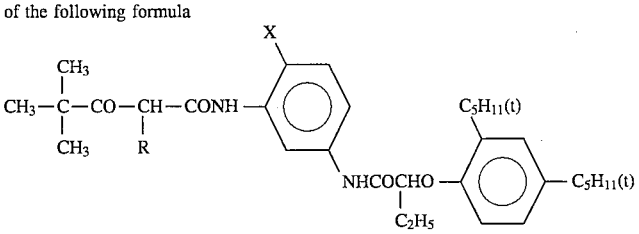
(ExM) Magenta coupler
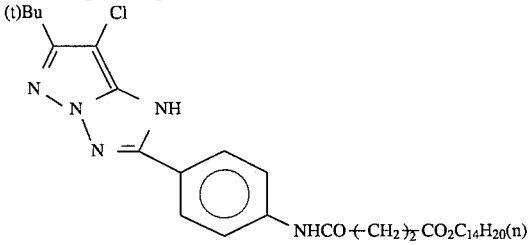
(ExC) Cyan coupler
Mixture (3:7 in molar ratio) of
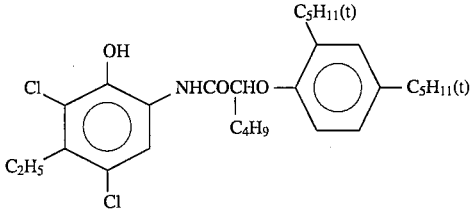
and
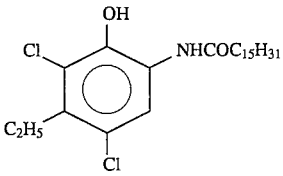
(Cpd-1) Image-dye stabilizer
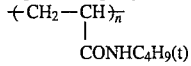
Av. molecular weight: 60,000
(Cpd-2) Image-dye stabilizer
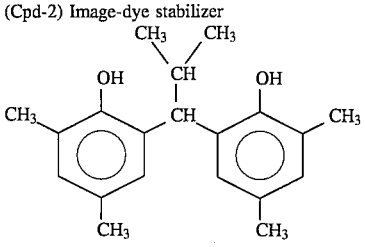

-continued
(Cpd-3) Image-dye stabilizer
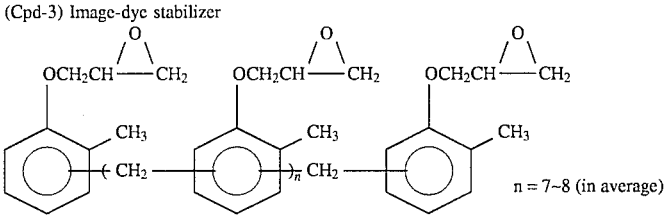
(Cpd-A) Color-mix inhibitor
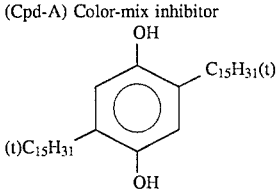
(Cpd-B) Clor-mix inhibitor
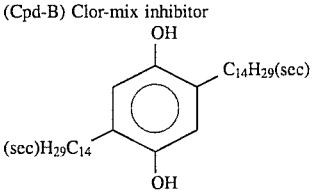
(Cpd-5) Image-dye stabilizer
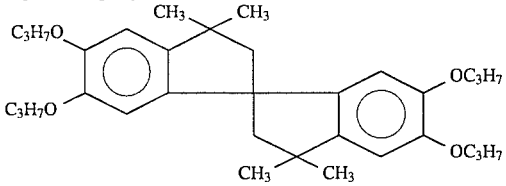
(Cpd-6) Image-dye stabilizer
Mixture (1:1 in molar ratio) of
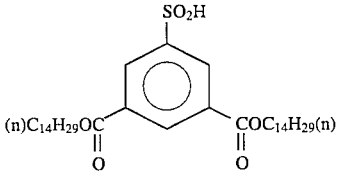
and
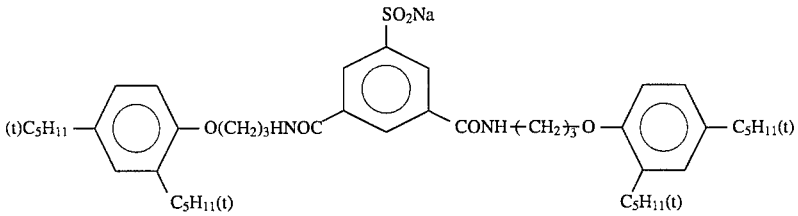
(Cpd-8) Image-dye stabilizer
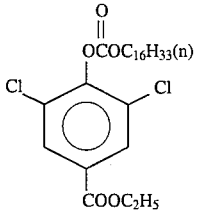
(Cpd-9) Image-dye stabilizer
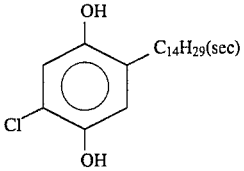
(Cpd-10) Image-dye stabilizer
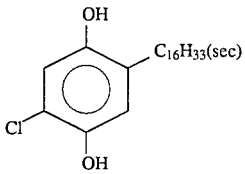
(Cpd-11) Image-dye stabilizer
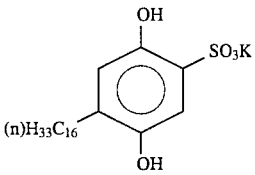

-continued
(Cpd-12) Image-dye stabilizer
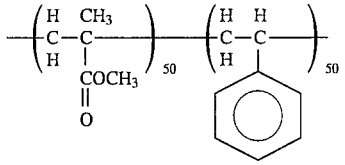
Av. molecular weight: 60,000
(Cpd-13) Image-dye stabilizer
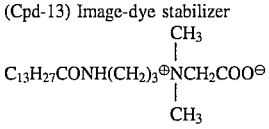
(Cpd-14) Antiseptic
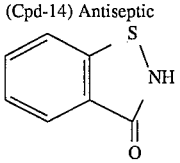
(Cpd-15) Antiseptic
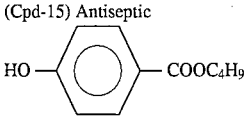
(UV-1) Ultraviolet ray absorber
Mixture of (i), (ii), (iii), and (iv) (10:5:1:5 in weight ratio)
(i)
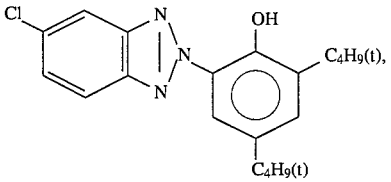
(ii)
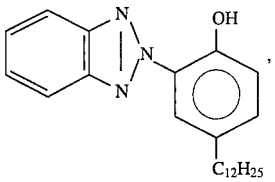
(iii)
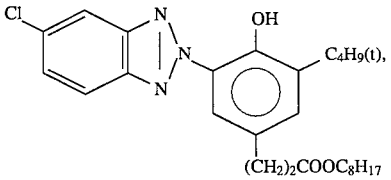
and
(iv)
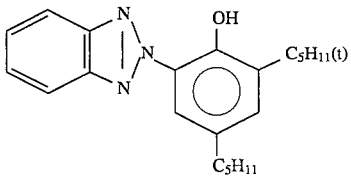
(UV-2) Ultraviolet ray absorber
Mixture of (1), (2), and (3) (1:2:2 in weight ratio)
(1)
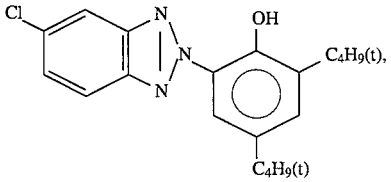
(2)
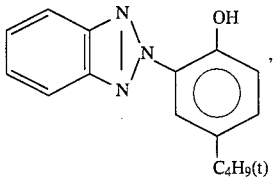
and
(3)
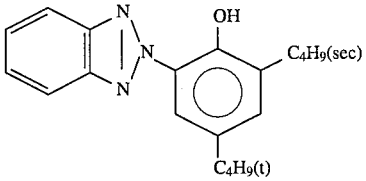
(Solv-1) Solvent
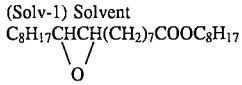
(Solv-2) Solvent
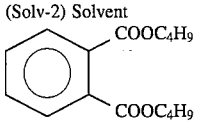

-continued (Solv-3) Solvent

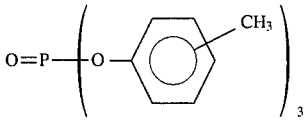

(Solv-4) Solvent

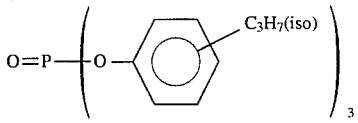

(Solv-5) Solvent

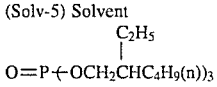

(Solv-6) Solvent

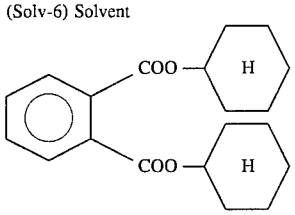

(Solv-7) Solvent

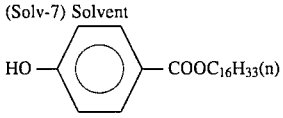

(Solv-8) Solvent

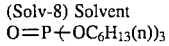

(Solv-9) Solvent

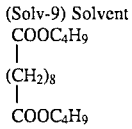

Samples 101 to 103 were prepared in the same manner as Sample 104, except that the polyethylene of support No. 104 was changed to the polyester of Support Nos. 101 to 103 shown in Table 1 above, respectively.

The thus prepared Samples (101 to 104) were cut up into small sheets and were given gradation exposure of a three-color separation filter for sensitometry by using a sensitometer (FW type, manufactured by Fuji Photo Film Ltd., Co. the color temperature of the light source: 3200K).

After exposure to light, each Sample was subjected to a continuous processing (running test) according to the processing process and processing solutions, shown below, until the replenishing amount reached to twice the tank volume of color developer.

| Processing step | Temperature | Time | Replenisher* | Tank Volume |
|---|---|---|---|---|
| Color developing | 40° C. | 25 sec | 73 ml | 2 liter |
| Bleach-fixing | 40° C. | 15 sec | 60 ml** | 2 liter |
| Rinse (1) | 35–40° C. | 7 sec | — | 1 liter |
| Rinse (2) | 35–40° C. | 7 sec | — | 1 liter |
| Rinse (3) | 35–40° C. | 7 sec | 120 ml | 1 liter |
| Drying | 80° C. | 20 sec | | |

Note:
*Replenisher amount per $m^2$ of photographic material.
Rinsing steps were carried out in 3-tanks countercurrent mode from the tank of rinsing (3) toward the tank of rinsing (1).
**60 ml corresponds 2 to times the amount of developer carried over from the developing bath.

In the above processing, water from rinse (3) was pressurized and fed to reverse osmosis membrane, and the permeated water was fed to rinse (3), while the concentrated water which had not permeated through the membrane was returned to rinse (2) and reused.

The composition of each processing solution was as follows, respectively:

| | Tank Solution | Replenisher |
|---|---|---|
| Color-developer | | |
| Water | 700 ml | 700 ml |
| Sodium triisopropylnaphthalene-(β) sulfonate | 0.1 g | 0.1 g |
| Ethylenediaminetetraacetic acid | 3.0 g | 3.0 g |
| Disodium 1,2-dihydroxybenzene-4,6-disulfonate | 0.5 g | 0.5 g |
| Triethanolamine | 12.0 g | 12.0 g |
| Potassium chloride | 6.5 g | — |
| Potassium bromide | 0.03 g | — |
| Potassium carbonate | 27.0 g | 27.0 g |
| Fluorescent whitening agent (UVITEX CK, made by Ciba Geigy Co.) | 1.0 g | 3.0 g |
| Sodium sulfite | 0.1 g | 0.1 g |
| Disodium N,N-bis(sulfonatoethyl)hydroxylamine | 10.0 g | 13.0 g |
| N-Ethyl-N-(β-methanesulfoneamidoethyl)-3-methyl-4-aminoaniline sulfonate | 7.0 g | 15.0 g |
| Water to make | 1000 ml | 1000 ml |
| pH (25° C.) | 10.35 | 11.6 |
| Bleach-fixing solution | | |
| Water | 600 ml | 150 ml |
| Ammonium thiosulfate (700 g/l) | 100 ml | 170 ml |
| Ammonium sulfite | 40 g | 80 g |
| Iron (III) ammonium ethylenediaminetetraacetate | 77 g | 130 g |
| Ethylenediaminetetraacetic acid | 5 g | 8.5 g |
| Ammonium bromide | 40 g | 65 g |
| Nitric acid (67%) | 30 g | 65 g |
| Water to make | 1000 ml | 1000 ml |
| pH (25° C.) | 5.8 | 5.0 |

(pH was adjusted by nitricc acid and aqueous ammonium)

Rinse solution (Both tank solution and replenisher)

Ion-exchanged water (calcium and magnesium each are 3 ppm or below)

The image density of each sample immediately after the continuous processing was evaluated.

The minimum density (Dmin) of the obtained images was measured through a G filter corresponding to magenta density. After 10 pieces of each sample were put together in layers and were stored at 40° C. and 70% relative humidity for 8 days, similar measurement was carried out and the increment (ΔDmin) of the image density due to the storage was calculated. The average values of the ΔDmin of the ten pieces are shown in Table 2.

TABLE 2

| Test No. | Sample No. | Δ Dmin | Remarks |
|---|---|---|---|
| 1-1 | 101 | 0.008 | This Invention |
| 1-2 | 102 | 0.008 | " |
| 1-3 | 103 | 0.010 | " |
| 1-4 | 104 | 0.025 | Comparative Example |

As is apparent from the results in Table 2, when samples having support defined in the present invention are processed rapidly with the rate of the replenishment being low, the magenta stain density is small after storage under high humidity and the occurrence of stain is suppressed.

EXAMPLE 2

Using Samples 102 and 104 of Example 1, after the Samples were exposed to light in the same manner as in Example 1, they were continuously processed by using the following processing steps and color developer composition and bleach-fix solution composition. Further, continuous processings were carried out by changing the replenishing amount of bleach-fix solution to 4.0 times (120 ml/m$^2$) the amount of developer carried over from the developing bath.

| Processing step | Temperature | Time | Replenisher* | Tank Volume |
|---|---|---|---|---|
| Color developing | 40° C. | 15 sec | 35 ml | 2 liter |
| Bleach-fixing | 40° C. | 15 sec | See Table 3 | 2 liter |
| Rinse (1) | 40° C. | 3 sec | — | 1 liter |
| Rinse (2) | 40° C. | 3 sec | — | 1 liter |
| Rinse (3) | 40° C. | 3 sec | — | 1 liter |
| Rinse (4) | 40° C. | 3 sec | — | 1 liter |
| Rinse (5) | 40° C. | 6 sec | 60 ml | 1 liter |
| Drying | 60–80° C. | 15 sec | | |

Note:
*Replenisher amount per m$^2$ of photographic material.
Rinsing steps were carried out in 5-tanks countercurrent mode from the tank of rinsing (5) toward the tank of rinsing (1).

In the above-described processing, water from rinse (5) was pressurized and fed to reverse osmosis membrane, and the permeated water was fed to rinse (5), while the concentrated water which had not permeated through the membrane was returned to rinse (4) and reused. Further, in order to shorten the cross-over time between each rinse step, blade was provided between respective rinse bathes through which the photographic material passed.

In the running processing, since the pH of the bleach-fix changes depending on the amount of the replenishment, during the processing the pH was adjusted.

The composition of each processing solution is as followed, respectively:

| | Tank Solution | Replenisher |
|---|---|---|
| Color-developer | | |
| Water | 700 ml | 700 ml |
| Ethylenediaminetetraacetic acid | 1.5 g | 3.75 g |
| Sodium triisopropylnaphthalene-(β) sulfonate | 0.01 g | 0.01 g |
| Disodium 1,2-dihydroxybenzene-4,6-disulfonate | 0.25 g | 0.7 g |
| Triethanolamine | 5.8 g | 14.5 g |
| Potassium chloride | 10.0 g | — |
| Potassium bromide | 0.03 g | — |
| Potassium carbonate | 30.0 g | 39.0 g |
| Fluorescent whitening agent (UVITEX CK, made by Ciba Geigy Co.) | 2.5 g | 5.0 g |
| Sodium sulfite | 0.14 g | 0.2 g |
| Disodium N,N-bis(sulfonatoethyl)hydroxylamine | 7.4 g | 15.0 g |
| 4-Amino-3-methyl-N-ethyl-N-(4-hydroxybutyl)aniline.2-p-toluenesulfonic acid | 14.5 g | 35.0 g |
| Water to make | 1000 ml | 1000 ml |
| pH (25° C.) | 10.05 | 10.60 |
| Bleach-fixing solution | | |
| Water | 600 ml | 300 ml |
| Ammonium thiosulfate (70%) | 100 ml | 250 ml |
| Ammonium sulfite | 40 g | 80 g |
| Iron (III) ammonium ethylenediaminetetraacetate | 77 g | 154 g |
| Disodium ethylenediaminetetraacetate | 5 g | 10 g |
| Ammonium bromide | 10 g | 20 g |
| Ethylenebisguanidine sulfonate | 12.0 g | 24 g |
| Acetic acid (50%) | 25 ml | 50 ml |
| Water to make | 1000 ml | 1000 ml |
| pH (25° C.) | 5.5 | 5.0 |

(pH was adjusted by acetic acid and aqueous ammonium)

Rinse solution (Both tank solution and replenisher)

Ion-exchanged water (calcium and magnesium each are 3 ppm or below)

Evaluation for image density of each Sample was conducted in the same manner as in Example 1. Results obtained are shown in Table 3.

The increment of stain density (ΔDmin) was designated according to the criteria shown below.

TABLE 3

| Test No. | Sample No. | Replenishing amount* | Evaluation of ΔDmin | Remarks |
|---|---|---|---|---|
| 2-1 | 102 | 0 times | x | Comparative example |
| 2-2 | " | 0.5 times | ○ | This invention |
| 2-3 | " | 1.0 times | ○ | " |
| 2-4 | " | 3.0 times | ◎ | " |
| 2-5 | " | 4.0 times | ◎ | Comparative Example |
| 2-6 | 104 | 0 times | x | " |
| 2-7 | " | 0.5 times | x | " |
| 2-8 | " | 1.0 times | x | " |
| 2-9 | " | 3.0 times | Δ | " |
| 2-10 | " | 4.0 times | ◎ | " |

0.005 or below: ◎ (storage stability: very good)
0.006–0.015: ○ (storage stability: good)
0.016–0.030: Δ (storage stability: bad)
0.030 or over: x (storage stability: very bad)
Note;
*Replenishing amount of bleach-fix solution is shown in a magnification number of carried over volume amount of developer from the developing bath.

As is apparent from the results in Table 3, when a support covered by polyethylene is used, the increment of stain density is remarkable in the case of replenishing amount of bleach-fixing solution being 3.0 times or below the carried over amount of developer from the developing bath. On the contrary, when a support according to the present invention is used, the effect of preventing the occurrence of stain due to storage is large in the case of replenishing amount being 3 times or below the carried over amount of developer from the developing bath, thus the occurrence of stain is less.

EXAMPLE 3

The same continuous processing as in Example 2 was carried out by using Sample 102 or 104. Immediately after the continuous processing, each Sample was processed using the resulting processing solutions according to the processing in Example 2, except that the time of bleach-fixing process was changed as shown in Table 4. Evaluation of stain densities was conducted in the same manner as in Example 7. Results are shown in Table 4, with the same criteria of evaluation as in Example 2.

TABLE 4

| Test No. | Sample No. | Replenishing amount* | Time of bleach-fixing | Evaluation of ΔDmin | Remarks |
|---|---|---|---|---|---|
| 3-1 | 102 | 1.0 times | 10 sec | ○ | This Invention |
| 3-2 | " | " | 15 sec | ○ | " |
| 3-3 | " | " | 25 sec | ◎ | " |
| 3-4 | " | " | 35 sec | ◎ | " |
| 3-5 | " | " | 45 sec | ◎ | " |
| 3-6 | " | " | 60 sec | ◎ | " |
| 3-7 | 104 | " | 10 sec | x | Comparative Example |
| 3-8 | " | " | 15 sec | Δ | Comparative Example |
| 3-9 | " | " | 25 sec | Δ | Comparative Example |
| 3-10 | " | " | 35 sec | ○ | Comparative Example |
| 3-11 | " | " | 45 sec | ◎ | Comparative Example |
| 3-12 | " | " | 60 sec | ◎ | Comparative Example |

Note:
*Replenishing amount of bleach-fix solution is shown in a magnification number of carried-over amount of developer.

As is apparent from the results in Table 4, when the processing is carried out by using a bleach-fix solution obtained by continuous low-replenishing-rate processing, in a processing time within 25 sec, stain of image of Sample after the storage increases in the case of using a support covered with polyethylene. On the contrary, when a support according to the present invention is used, the stain density is small, showing that the occurrence of stain is suppressed. The desilvering was insufficient when the time of bleach-fixing process was 5 sec or less, so that a comparison can not be made because of higher Dmin.

EXAMPLE 4

A test was conducted in the same manner as in Example 2, except that the replenishing water volume of the rinse (5) (the final bath) used in Example 2 was changed and Sample 102 was used. The replenishing water volume of the rinse (5) was changed and the concentration of iron in the rinse (5) solution after the running test was measured by atomic absorption spectrometry, and the results are shown in Table 5. The evaluation of stain densities that were caused by processing with the rinse (5) having respective iron concentrations was carried out in the same manner as in Example 1, and results are shown in Table 5, with the same criteria of evaluation as Example 2.

TABLE 5

| Test No. | Sample No. | Concentration of iron (ppm) | Evaluation of ΔDmin | Remarks |
|---|---|---|---|---|
| 4-1 | 102 | 0.5 | ◎ | This Invention |
| 4-2 | " | 10 | ◎ | " |
| 4-3 | " | 20 | ○ | " |
| 4-4 | " | 30 | ○ | " |
| 4-5 | " | 40 | x | Comparative example |

As a result, it was found that when the iron concentration of the rinse (5) in the final washing bath was brought to more than 30 ppm, the occurrence of stain is accelerated considerably resulting in the stain being increased.

EXAMPLE 5

With respect to photographic materials prepared in Examples 1, the same evaluation as that in Example 1 was repeated, except that the following exposure to light was carried out. The obtained results were the same as those of Examples 1.

(Exposure to light)

The light sources used were a laser beam of wavelength 473 nm, which was taken out by wavelength conversion using an SHG crystal of $KNbO_3$ from YAG solid laser (oscillation wavelength: 946 nm), which used as an excitation light source a GaAlAs semiconductor laser (oscillation wavelength: 808.5 nm), a laser beam of wavelength 532 nm, which was taken out by wavelength conversion using an SHG crystal of KTP from $YVO_4$ solid laser (oscillation wavelength: 1064 nm), which used as an excitation light source a GaAlAs semiconductor laser (oscillation wavelength: 808.7 nm), and a laser beam of AlGaInP (oscillation wavelength: about 670 nm; Type No. TOLD9211, manufactured by Toshiba Co.). The apparatus can carry out the exposure in such a manner that laser beams can scan successively a color photographic printing paper moving vertically to the direction of the scanning by respective rotating polyhedrons. Using this apparatus to change the quantity of light, the relationship D—log E between the density (D) of the photographic material and the quantity of light (D) was determined. At that time, the quantities of the lights of laser beams having three wavelengths were modulated by using an external modulator to control the exposure amount. The scanning exposure was carried out at 400 dpi and the average exposure time per picture element was about $5\times10^{-8}$ sec. The temperature of the semiconductor laser was kept by using a Peltier device to prevent the quantity of light from being changed by temperature.

Having described our invention as related to the present embodiments, it is our intention that the invention not be limited by any of the details of the description, unless otherwise specified, but rather be construed broadly within its spirit and scope as set out in the accompanying claims.

What I claim is:

1. A method for forming a color image in a silver halide color photographic material comprising a reflective support having coated thereon a composition comprising a polyester resin and a white pigment mixed and dispersed in said polyester resin, at least one yellow color forming silver halide photosensitive emulsion layer, at least one magenta color forming silver halide photosensitive emulsion layer and at least one cyan color forming silver halide photosensitive emulsion layer on said support, each of said yellow, magenta and cyan color forming silver halide photosensitive emulsion layers having silver halide grains containing 95 mol % or more of silver chloride and positioned on a side of said support containing said composition thereon, wherein said method comprises the steps of:

(i) exposing imagewise said silver halide color photographic material to light, (ii) developing said imagewise exposed silver halide color photographic material in a color developer solution, (iii) subjecting said developed silver halide color photographic material to a desilvering bath, (iv) subjecting said silver halide color photographic material to a washing bath or to a stabilizing bath, and (v) drying said developed silver halide color photographic material, wherein the amount of replenishment for said desilvering bath (iii) is 0.5 to 3 times the amount of the color developer solution carried over from said developer solution (ii) into said desilvering bath (iii).

2. The method for forming a color image as claimed in claim 1, wherein the washing bath or the stabilizing bath is operated in a multi-stage counterflow mode and the iron ion concentration of the final stage of the multi-stage counterflow mode is 30 ppm or less.

3. The method for forming a color image as claimed in claim 1, wherein the said resin comprises 50 wt % or more of polyester obtained by condensing at least one kind of dicarboxylic acid with at least one kind of diol.

4. The method for forming a color image as claimed in claim 1, wherein the polyester of the polyester resin is a polyester containing more than 50% polyethylene terephthalate.

5. The method for forming a color image as claimed in claim 1, wherein the polyester of the polyester resin is synthesized by condensation polymerization of dicarboxylic acid which is a mixture of terephthalic acid and isophthalic acid in a molar ratio of from 9:1 to 2:8, and a diol, a surface of the support which is emulsion-coated is coated with a composition containing the polyester resin mixed and dispersed with a white pigment, and the other surface of the support is coated with a resin or a composition containing the resin mixed and dispersed with a powder.

6. The method for forming a color image as claimed in claim 1, wherein the polyester of the polyester resin is synthesized by condensation polymerization of dicarboxylic acid which is a mixture of terephthalic acid and naphthalenedicarboxylic acid in a molar ratio of from 9:1 to 2:8, and a diol, a surface of the support which is emulsion-coated is coated with a composition containing the polyester resin mixed and dispersed with a white pigment, and the other surface of the support is coated with a resin or a composition containing a resin mixed and dispersed with a powder.

7. The method for forming a color image as claimed in claim 3, wherein the dicarboxylic acid is selected from the group consisting of terephthalic acid, isophthalic acid, and naphthalenedicarboxylic acid.

8. The method for forming a color image as claimed in claim 3, wherein the diol is selected from the group consisting of ethylene glycol, butylene glycol, neopentyl glycol, triethylene glycol, butanediol, hexylene glycol, an adduct of bisphenol A with ethylene oxide, and 1,4-dihydroxymethylcyclohexane.

9. The method for forming a color image as claimed in claim 3, wherein the diol is ethylene glycol.

10. The method for forming a color image as claimed in claim 1, wherein the mixing weight ratio of the polyester resin to the white pigment is in the range from 98:2 to 30:70.

11. The method for forming a color image as claimed in claim 1, wherein the white pigment is selected from the group consisting of titanium oxide, barium sulfate, lithopone, aluminum oxide, calcium carbonate, silicon oxide, antimony trioxide, titanium phosphate, zinc oxide, white lead, and zirconium oxide, and finely divided powders of a polystyrene and a styrene/divinylbenzene copolymer.

12. The method for forming a color image as claimed in claim 1, wherein the white pigment is titanium oxide, and the weight ratio of the titanium oxide to the polyester resin is the range from 5:95 to 40:60.

13. The method for forming a color image as claimed in claim 1, wherein the period of time for desilvering step (iii) is 5 to 25 sec.

14. The method for forming a color image as claimed in claim 1, wherein the period from the start of developing step (ii) to the end of drying step (v) is within 120 sec.

15. The method for forming a color image as claimed in claim 1, wherein said color photographic material is exposed to light in a scanning exposure method with the exposure time being $10^{-4}$ sec or less per picture element.

16. The method for forming a color image as claimed in claim 1, wherein a color-developing agent for use in the color developer solution of step (ii) is a p-phenylenediamine derivative represented by the following formula (Dev):

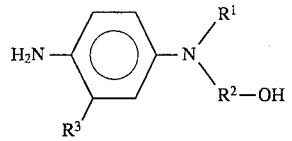

formula (Dev)

wherein $R^1$ and $R^3$ each represent an alkyl group having 1 to 4 carbon atoms, and $R^2$ represents a straight-chain or branched chain alkylene group having 3 to 4 atoms.

17. The method for forming a color image as claimed in claim 1, wherein the pH of the desilvering bath is 3 to 5.8.

18. The method for forming a color image as claimed in claim 1, wherein said white pigment is mixed and dispersed in said polyester resin containing 50 wt % or more of a polyester.

19. The method for forming a color image as claimed in claim 1, wherein the white pigment is selected from the group consisting of titanium oxide, barium sulfate, lithopone, aluminum oxide, calcium carbonate, silicon oxide, antimony trioxide, titanium phosphate, zinc oxide, white lead, zirconium oxide, polystyrene and styrene/divinylbenzene copolymer.

20. The method for forming a color image as claimed in claim 1, wherein the white pigment has an average particle diameter of 0.1 to 0.8 μm.

21. The method for forming a color image as claimed in claim 1, wherein the weight ratio of the polyester to the white pigment is from 98:2 to 30:70.

22. The method for forming a color image as claimed in claim 1, wherein the color developer solution is replenished at a rate of 20 to 600 ml per $m^2$ of said color photographic material.

23. The method for forming a color image as claimed in claim 1, wherein said desilvering bath is replenished at a rate of 5 to 120 ml per $m^2$ of said color photographic material.

24. The method for forming a color image as claimed in claim 1, wherein the color developer solution is replenished at a rate of 20 to 600 ml per $m^2$ of said color photographic material, and said desilvering bath is replenished at a rate of 5 to 120 ml per $m^2$ of said color photographic material.

25. The method for forming a color image as claimed in claim 1, wherein the desilvering bath comprises a bleaching bath and a fixing bath.

26. The method for forming a color image as claimed in claim 1, wherein the desilvering bath comprises a bleach-fixing bath.

* * * * *